US007325900B2

(12) United States Patent
Hayashi et al.

(10) Patent No.: US 7,325,900 B2
(45) Date of Patent: Feb. 5, 2008

(54) PRINTING APPARATUS AND INCLINATION CORRECTION METHOD

(75) Inventors: Masashi Hayashi, Sagamihara (JP); Norihiro Kawatoko, Kawasaki (JP); Toshiyuki Chikuma, Kawasaki (JP); Hidehiko Kanda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/480,433

(22) Filed: Jul. 5, 2006

(65) Prior Publication Data

US 2007/0008360 A1 Jan. 11, 2007

(30) Foreign Application Priority Data

Jul. 8, 2005 (JP) ..... 2005-200158

(51) Int. Cl.
*B41J 2/15* (2006.01)

(52) U.S. Cl. ..... 347/41; 347/19

(58) Field of Classification Search ..... 347/19, 347/41, 12, 14

See application file for complete search history.

(56) References Cited

U.S. PATENT DOCUMENTS

| | | | | |
|---|---|---|---|---|
| 5,956,055 | A | 9/1999 | Gibson et al. | 347/40 |
| 6,364,446 | B1 | 4/2002 | Ishikawa et al. | |
| 6,554,387 | B1 * | 4/2003 | Otsuki | 347/19 |
| 6,913,337 | B2 | 7/2005 | Kuronuma et al. | |
| 2002/0145640 | A1 * | 10/2002 | Anderson et al. | 347/19 |
| 2007/0008361 | A1 | 1/2007 | Kawatoko et al. | |
| 2007/0013726 | A1 | 1/2007 | Hayashi et al. | |
| 2007/0013732 | A1 | 1/2007 | Sakamoto et al. | |

FOREIGN PATENT DOCUMENTS

| | | |
|---|---|---|
| EP | 0 674 993 A2 | 10/1995 |
| JP | 7-40551 | 2/1995 |
| JP | 7-309007 | 11/1995 |
| JP | 11-240143 | 9/1999 |
| JP | 2004-9489 | 1/2004 |

* cited by examiner

*Primary Examiner*—Lamson D. Nguyen
(74) *Attorney, Agent, or Firm*—Fitzpatrick, Cella, Harper & Scinto

(57) ABSTRACT

When bidirectional multi-pass printing is carried out by use of a printing head having an inclination, even if a bidirectional printing is somewhat displaced, an inclination of a printing position is corrected in a state where "band unevenness" is suppressed as much as possible. In order to realize the correction described above, a division number B for dividing a plurality of printing elements into a plurality of blocks, and a timing at which each of the blocks is driven, are set on the bases of inclination information on the printing head and the number of multi-passes. Thus, even if the bidirectional printing is displaced, printing widths are equally increased or reduced in the respective regions. Consequently, it is made possible to avoid the "band unevenness" which is caused by differences in the printing width among the regions.

9 Claims, 41 Drawing Sheets

BLOCK NUMBER 2

DIVISION NUMBER (B)

PASS NUMBER (P)

| | 2 | 3 | 4 | 5 | 6 | 7 | 8 | 9 | 10 |
|---|---|---|---|---|---|---|---|---|---|
| 1 | ○ | ○ | ○ | ○ | ○ | ○ | ○ | ○ | ○ |
| 2 | ○ | — | ○ | — | ○ | — | ○ | — | ○ |
| 3 | — | ○ | — | — | ○ | — | — | ○ | — |
| 4 | × | — | ○ | — | — | — | ○ | — | — |
| 5 | — | — | — | ○ | — | — | — | — | ○ |
| 6 | ○ | × | — | — | ○ | — | — | — | — |
| 7 | — | — | — | — | — | ○ | — | — | — |
| 8 | × | — | × | — | — | — | ○ | — | — |
| 9 | — | ○ | — | — | — | — | — | ○ | — |
| 10 | ○ | — | — | × | — | — | — | — | ○ |
| 11 | — | — | — | — | — | — | — | — | — |
| 12 | × | × | ○ | — | × | — | — | — | — |

FIG.23

| | | NOZZLE TILT AMOUNT (/600dpi) | | | | | | |
|---|---|---|---|---|---|---|---|---|
| | | ··· | -2 | ··· | 0 | ··· | 2 | ··· |
| SHIFT AMOUNT | SECTION 1 (0-31NOZZLE) | | 0 | | 0 | | 0 | |
| | SECTION 2 (32-63NOZZLE) | | 0 | | 0 | | 0 | |
| | SECTION 3 (64-95NOZZLE) | | 0 | | 0 | | 0 | |
| | SECTION 4 (96-127NOZZLE) | | -1 | | 0 | | 1 | |
| | SECTION 5 (128-161NOZZLE) | | -1 | | 0 | | 1 | |
| | SECTION 6 (162-191NOZZLE) | | -1 | | 0 | | 1 | |

(/600dpi)

FIG.25

DIVISION NUMBER 2

DIVISION NUMBER 2

DIVISION NUMBER 2

DIVISION NUMBER 4

| | GRAININESS | BAND UNEVENNESS |
|---|---|---|
| NO CORRECTION | × | × |
| BLOCK DIVISION NUMBER 2 | ○ | ○ |
| BLOCK DIVISION NUMBER 3 | ○ | △ |

FIG.41

PRINTING APPARATUS AND INCLINATION CORRECTION METHOD

BACKGROUND OF THE INVENTION

1. Field of the Invention

The present invention relates to a printing apparatus which forms an image by applying a printing agent onto a printing medium from printing means having a plurality of printing elements which are arranged therein. Particularly, the present invention relates to a method and a configuration for controlling a displacement in a printing position of the printing element.

2. Description of the Related Art

In an ink jet printing apparatus, generally, a printing head including a plurality of printing elements integrally arranged is used. Specifically, each of the printing elements includes an ink discharge port and a liquid path for supplying ink to the ink discharge port. Moreover, in order to deal with a color image, many ink jet printing apparatuses include such printing heads for a plurality of colors. The ink jet printing apparatuses are generally classified into a serial type and a line type depending on differences in printing operations thereof. The serial type printing apparatus, which is easily reduced in size, is widely used mainly for personal use in particular.

In such a serial type ink jet printing apparatus, a printing position on a printing medium may include an inclination due to arrangement tolerance of a plurality of ink discharge ports arranged in the printing head, an error in mounting the printing head on the printing apparatus, and the like.

FIG. 1 is a view for explaining the inclination described above. Even if printing of a parallel line pattern in a sub-scanning direction is attempted, a ruled line in a state of being inclination to the sub-scanning direction as shown in FIG. 1 is formed when a printing head having an inclination is used. Here, FIG. 1 shows a case where a displacement for 3 pixels is generated between printing elements positioned at both ends of the printing head at a 1200 dpi (dot/inch) printing resolution. In the serial printing apparatus, an image is formed by intermittently repeating main print scanning for forming an image while moving and scanning the printing head on a printing medium and sub-scanning for transporting the printing medium in a direction which intersects the main print scanning. Thus, even if the ruled line extended in the sub-scanning direction is printed, the line is split into pieces in each print scanning if such an inclination is included. Accordingly, only the ruled line with poor linearity can be obtained. Furthermore, in the case where a color image is formed by including such printing heads for a plurality of colors, other adverse effects, such as occurrence of color shading and worsening of graininess (feeling of roughness when viewing the image) may even be induced.

As described above, in the serial type ink jet printing apparatus, the adverse effect on the image due to the inclination has heretofore been one of significant issues. Moreover, some of various measures for coping with the inclination as described above have already been proposed and implemented.

For example, Japanese Patent Application Laid-open No. 7-309007 (1995) discloses an ink jet printing system including an error correction circuit, which adds an offset to image data to be printed by the respective discharge ports, in order to reduce a printing position error caused by rotation of the printing head. Moreover, Japanese Patent Application Laid-open No. 7-040551 (1995) discloses an ink jet printing apparatus, in which a plurality of discharge port arrays arranged on a printing head are divided into a plurality of blocks, and a sequence of discharge in each block and intervals of discharge are adjusted according to the inclination. Furthermore, No. 11-240143 (1999) discloses a method for printing image data in the following manner. Specifically, in order to correct a displacement, which is caused by the inclination of the printing head, of a printing position in a connection part of each print scanning, an offset is set on the bases of a displacement between a printing position by an uppermost discharge port and a printing position by a lowermost discharge port, and the data is displacement ed by an amount based on the offset for a part of the discharge ports. Furthermore, Japanese Patent Application Laid-open No. 2004-009489 discloses an ink jet printing apparatus having means for changing allocation of data to be printed by the respective discharge ports according to the inclination of the printing head.

FIG. 2 shows an example of executing inclination correction for the printing head having the inclination shown in FIG. 1 by use of the method disclosed in Japanese Patent Application Laid-open No. 11-240143 (1999). In the case of the printing head in FIG. 1, both ends of each of discharge ports are in a state of being away from each other by 3 pixels. Thus, in this example, a plurality of discharge ports (printing elements), which are arranged on the printing head, are divided into 3 blocks 201 to 203. Moreover, the block 202 is set to discharge ink at a timing later (or earlier) than the block 201 by 1 pixel, and the block 203 is set to discharge the ink at a timing later (or earlier) than the block 202 further by 1 pixel. As a result of performing such control, a width d204 of a ruled line after correction is suppressed to be smaller than a width d101 of the ruled line before correction. Thus, a ruled line pattern with better linearity is realized.

Note that, in Japanese Patent Application Laid-open No. 11-240143 (1999), adopted is a method for shifting printing data given to the printing elements in each block by 1 pixel in the main scanning direction in order to discharge the ink while shifting the timing of discharge among the blocks. Meanwhile, according to Japanese Patent Application Laid-open Nos. 7-309007 (1995) and 7-040551 (1995), the following method is disclosed. Specifically, in order to respond to a minute inclination within a range of 1 pixel, a drive signal for discharge is generated while shifting the timing among a plurality of blocks within a time equivalent to 1 pixel region. Both of the methods described above are the same in content that the plurality of printing elements is divided into the plurality of blocks, and that the ink is discharged while shifting the timing among the blocks.

However, even if the methods described in the foregoing patent documents are adopted, sufficient image quality may not be obtained if multi-pass printing is executed by bidirectional print scanning, for example.

Here, the multi-pass printing will be briefly described. In the multi-pass printing, data to be printed in the same image region are divided by use of a plurality of patterns, which are in a complementary relationship, and an image is gradually formed by performing print scanning more than once. Between the respective print scanning, a printing medium is transported by an amount smaller than a printing width of the printing head. Thus, a line leading in the main scanning direction are formed of multiple kinds of printing elements. Printing characteristics of the respective printing elements are, therefore, dispersed in the entire image to smoothen the entire image. Generally, a transportation amount (hereinafter also referred to as an LF width) of the printing medium when the multi-pass printing is carried out is obtained by equally dividing a printing width H of the printing head with respect to the sub-scanning direction by a multi-pass number P. Specifically, the LF width is set to H/2 in printing with 2 passes, and is set to H/6 in printing with 6 passes.

According to the study done by the inventors of the present invention, description will be given for influences of the inclination of the printing head, and of a displacement in a bidirectional printing on an image in bidirectional multi-pass printing, and for problems when conventional inclination correction is carried out. Note that, in the present specification, the displacement in the bidirectional printing is defined as a state where printing positions on the printing medium by forward scanning and backward scanning of the printing head are displacement ed with respect to the main scanning direction. Moreover, a displacement amount of the bidirectional printing is defined as an amount of the displacement.

FIG. 3 shows a state where a ruled line having a width d, which is parallel to a sub-scanning direction; is printed by bidirectional printing with two passes by use of a printing head having no inclination when no displacement in a bidirectional printing exists. In first print scanning, the printing head prints a part of ruled line data in a position shown in FIG. 3 while moving in a forward direction. Subsequently, sub-scanning is performed for a half (that is, H/2) of a printing width. Thereafter, the printing head performs second print scanning while moving in a backward direction. In a region A where the second print scanning and the first print scanning overlap with each other, a combination of dots in a complementary relationship forms a ruled line pattern. As a result of similarly performing third print scanning and fourth print scanning, and further performing a transportation operation between the respective print scanning, a ruled line pattern as shown in FIG. 3 is formed.

Here, a state in an ideal complementary relationship satisfies the following four conditions. First, dots, which form a longitudinal ruled line image, are arranged in a checker array. Secondly, checker array data are formed of binary data. Third, in the case of data corresponding to level 0 among the binary data, no ink is discharged (0 shot). Fourth, in the case of data corresponding to level 1 among the binary data, two shots of ink droplets are discharged. Moreover, the ink droplets are discharged so as to overlap with each other in the same position between the first pass and the second pass.

In this example, since the printing head has no inclination, the ruled line pattern partially printed in each print scanning is parallel to the sub-scanning direction. In addition, since no displacement in the bidirectional printing exists, a region printed in the forward scanning and a region printed in the backward scanning completely overlap with each other. Thus, an image completed by bidirectional multi-pass printing with two passes is set to be a ruled line, which is parallel to the sub-scanning direction, which has the width d, and which is excellent in linearity.

FIG. 4 is an enlarged schematic view for explaining states of dots printed in regions B and C shown in FIG. 3. As is clear from FIG. 4, the complementary relationship is maintained between dots printed in the forward scanning and dots printed in the backward scanning. Accordingly, an even image excellent in dispersibility of dots is formed within a printing region having the width d.

FIG. 5 shows a pattern similar to that shown in FIG. 3, which is formed by the bidirectional printing with two passes by use of the printing head having no inclination when a displacement in the bidirectional printing exists. As in the case of FIG. 3, since the printing head has no inclination, the ruled line pattern partially printed in each print scanning is parallel to the sub-scanning direction. However, since a displacement in the bidirectional printing exists, a region printed in the forward scanning and a region printed in the backward scanning overlap with each other in the state of being shifted from each other in the main scanning direction. Thus, an image completed by bidirectional multi-pass printing with two passes is set to be a ruled line, which is parallel to the sub-scanning direction, but which has a width d' larger than the width d.

FIG. 6 is an enlarged schematic view for explaining states of dots printed in regions B and C. As is clear from FIG. 6, dots printed in the forward scanning and dots printed in the backward scanning are disposed in positions shifted from each other. Thus, the complementary relationship therebetween is impaired. Within a printing region of such an image, dispersibility of dots is biased, and this is visually recognized as "graininess". However, since the regions B and C have the same degree of dispersibility of dots, no difference is perceived between the regions.

FIG. 7 shows a pattern similar to that shown in FIG. 3, which is formed by the bidirectional printing-with two passes by use of a printing head having an inclination when no displacement in the bidirectional printing exists. Here, since the printing head has an inclination, the ruled line pattern printed in each print scanning has inclination to the sub-scanning direction. Although no displacement in the bidirectional printing exists, each region is printed by different portions (upper half and lower half) of the printing head respectively in the forward scanning and in the backward scanning. Thus, a region printed in the forward scanning and a region printed in the backward scanning are shifted from each other in the main scanning direction. Thus, an image completed by bidirectional multi-pass printing with two passes is set to be a ruled line having a width d1001 larger than the width d.

FIG. 8 is an enlarged schematic view for explaining states of dots printed in regions B and C. As is clear from FIG. 8, dots printed in the forward scanning and dots printed in the backward scanning are disposed in positions shifted from each other. Thus, the complementary relationship therebetween is impaired. However, since the regions B and C have the same degree of dispersibility of dots, no difference is perceived between the regions.

FIG. 9 shows a pattern similar to that shown in FIG. 3, which is formed by the bidirectional printing with two passes by use of the printing head having an inclination when a displacement in the bidirectional printing exists. Here, since the printing head has an inclination, the ruled line pattern printed in each print scanning has inclination to the sub-scanning direction. In the forward scanning and the backward scanning, each region is printed by different portions (upper half and lower half) of the inclined printing head. Furthermore, the printing is influenced by the displacement in the bidirectional printing. Thus, a displacement amount in the main scanning direction between the forward scanning and the backward scanning varies depending on the region. In FIG. 9, for example, in a region B, there is no displacement between a printing position in the forward scanning and a printing position in the backward scanning. On the other hand, in a region C, there is a large displacement therebetween.

FIG. 10 is an enlarged schematic view for explaining states of dots printed in the regions B and C. As is clear from FIG. 10, in the region B, a complementary relationship is maintained between dots printed in the forward scanning and dots printed in the backward scanning. On the other hand, in the region C, dots printed in the forward scanning and dots printed in the backward scanning are disposed in positions, which are displaced from each other. Thus, in the region C, the complementary relationship is impaired, and "graininess" is perceived more easily than in the region B. In a case where the print scanning is continued further, two regions each having different degrees of "graininess", such as the regions B and C, are alternately disposed in the sub-scanning direction. This state is recognized as unevenness having a cycle in the sub-scanning direction. As described above, cyclic unevenness caused by a combination of the inclination of the printing head and the displacement in the bidirectional printing will be hereinafter referred to as "band unevenness" in the present specification. Generally, in the bidirectional multi-pass printing, such "band unevenness" is more visible than the "graininess" described above, and is a significant factor which impairs image quality.

Next, description will be given for a printing state when the inclination correction described in the section of the related art is carried out for the printing head having an inclination as shown in FIGS. 7 and 9.

FIG. 11 shows a pattern similar to that shown in FIG. 3, which is formed by bidirectional printing with two passes while correcting an inclination by use of the printing head having an inclination when no displacement in the bidirectional printing exists.

FIG. 12 is a view showing block divisions for correcting the inclination of the printing head. Here, a plurality of printing elements are divided into two blocks of a block 1501 and a block 1502, and timings at which the both blocks are driven are shifted from each other in a direction of inclination correction. With reference to FIG. 11 again, since the inclination correction performed, a width d1401 of the ruled line is set smaller than the width d1001 (FIG. 7) in the state where no inclination correction is performed. Moreover, since no displacement in the bidirectional printing exists, each region is not displaced from each other between the forward scanning and the backward scanning. Thus, "graininess" is maintained in a desirable state in the respective regions.

The above description has been given for the printing state at the time when the bidirectional printing with two passes is executed while performing 2-division inclination correction. Furthermore, in order to examine more cases, a case of bidirectional printing with six passes will be described below.

FIG. 13 shows a pattern similar to that shown in FIG. 3, which is formed by the bidirectional printing with six passes by use of a printing head having an inclination when no displacement in a bidirectional printing exists. In the case of the bidirectional printing with six passes, an image is formed by performing 6 times of print scanning in total, including 3 times of the forward scanning and 3 times of the backward scanning, in each region. Here, since the printing head has an inclination, the ruled line pattern printed in each print scanning inclines to the sub-scanning direction. Although no displacement in the bidirectional printing exists, the forward scanning and the backward scanning for each region are performed each by use of different portions of the inclined printing head. Thus, the region printed by forward scanning and the region printed by backward scanning are displaced from each other in the main scanning direction. Accordingly, an image completed by bidirectional multi-pass printing with six passes is set to be a ruled line having a width d1603 larger than the width d.

Since dots printed in the forward scanning and dots printed in the backward scanning are disposed in positions displaced from each other, the complementary relationship therebetween is impaired. However, the degree of displacement amounts (for example, d1601 and d1602) between printing positions in the forward scanning and printing positions in the backward scanning is the same among a plurality of regions including regions D and E. Thus, the degree of dispersibility of dots is set the same among the respective regions, and no "band unevenness" is perceived.

FIG. 14 shows a pattern similar to that shown in FIG. 3, which is formed by the bidirectional printing with six passes by use of the printing head having an inclination when a displacement in the bidirectional printing exists. As in the case of FIG. 13, since the printing head has an inclination, the ruled line pattern printed in each print scanning is inclined to the sub-scanning direction. Since a plurality of print scanning for each region are performed each by use of different portions of the inclined printing head, the region printed by six scanning are displaced from each other in the main scanning direction. Furthermore, since the displacement in the bidirectional printing exists, displacement widths in the main scanning direction among the plurality of print scannings vary depending on the region. In FIG. 14, for example, a displacement width d1701 in a region D is smaller than a displacement width d1702 in a region E. The fact, as described above, that the displacement width between the print scannings differs in each region leads to a difference in a complementary state of dots among the regions. As a result, occurrence of "band unevenness" is induced.

Next, description will be given for a division method for correcting an inclination of the printing head. FIGS. 15A to 15C are views, which show a plurality of block division methods for correcting the inclination of the printing head, and which show inclination correction states in the respective division methods. FIG. 15A shows a driving state when inclination correction is not executed (top) and a printing result thereof (bottom). When the inclination correction is not executed, all the printing elements of the printing head are driven approximately at the same time, and the printing result is in a state where the inclination of the printing head remains. A ruled line width (hereinafter referred to as an inclination width) in this event is set to be d1806.

FIG. 15B shows a state where the printing elements arranged in the printing head are equally divided into two of upper and lower blocks, and where the respective blocks are driven by shifting timings in a direction for correcting the inclination of the printing head (top), and a printing result thereof (bottom). Since 2-division inclination correction is performed, an inclination width d1807 after correction is set smaller than d1806. Thus, a ruled line having better linearity can be obtained.

FIG. 15C shows a state where the printing elements arranged in the printing head are equally divided into three blocks, and where the respective blocks are driven by shifting timings in the direction for correcting the inclination of the printing head (top), and a printing result thereof (bottom). Since 3-division inclination correction is performed, an inclination width d1808 after correction is set smaller than the inclination width d1807 after the 2-division inclination correction. Thus, a ruled line having better linearity can be obtained.

FIG. 16 shows a ruled line pattern formed by bidirectional printing with six passes while performing 2-division inclination correction by use of the printing head having an inclination when no displacement in a bidirectional printing exists. Since the inclination correction is performed, a width d1901 of an image is set to be further smaller than the width d1603 obtained when no inclination correction is performed. Although no displacement in the bidirectional printing exists, each region includes some displacements between the forward scanning and the backward scanning, due to the configuration in which the 2-division inclination correction and multi-pass printing with six passes are performed. However, since such a displacement amount is not changed for each region, no "band unevenness" occurs.

FIG. 17 shows a ruled line pattern formed by the bidirectional printing with six passes while performing 3-division inclination correction by use of the printing head having an inclination when no displacement in the bidirectional printing exists. Since the inclination correction is performed, a width d2001 of an image is set to be further smaller than that in the case of the 2-division inclination correction shown in FIG. 16. Although no displacement in the bidirectional printing exists , each region includes some displacement s between the forward scanning and the backward scanning, due to the configuration in which the 3-division inclination correction and the multi-pass printing with six passes are performed. However, as in the case of FIG. 16, since such a displacement amount is not changed for each region, no "band unevenness" occurs.

According to the above description with reference to FIGS. 15A to 17, the larger the division number for inclination correction is, the more the displacement width of the printing position in the main scanning direction can be suppressed. Thus, it can be determined that an image can be formed in a desirable state. However, the keen examination by the inventors of the present invention has confirmed that, if the displacement in the bidirectional printing exists, a desirable image is not necessarily formed by correction using a larger division number.

FIGS. 18A and 18B are views showing how the bidirectional printing with six passes is carried out while performing 2-division inclination correction in a state where the printing head having an inclination is used, and where a displacement in the bidirectional printing exists. FIG. 18A is a view showing printing positions of two blocks when the respective blocks are driven while timings therebetween are shifted. In the bidirectional printing with six passes, main scanning and sub-scanning are alternately repeated. Specifically, in the main scanning, ink is discharged while the printing head in the printing state as described above is bidirectionally moved. Moreover, in the sub-scanning, a printing medium is transported by an amount corresponding to an LF width (=H/6) shown in FIG. 18A. Thus, for example, when a printing region D of the printing medium is in focus, in the region, the forward scanning is performed by use of portions 2301 and 2303 of a first block and a portion 2305 of a second block, and the backward scanning is performed by use of a portion 2302 of the first block and portions 2304 and 2306 of the second block. Both of a sum of the portions printed by the forward scanning and a sum of the portions printed by the backward scanning cover the entire inclination width d1807 (see FIG. 15B) after the inclination correction.

Meanwhile, in a printing region E adjacent to the region D, an image is formed in a state where the forward scanning and the backward scanning are reversed from those in the region D. Specifically, the forward scanning is performed by use of the portion 2302 of the first block and the portions 2304 and 2306 of the second block, and the backward scanning is performed by use of the portions 2301 and 2303 of the first block and the portion 2305 of the second block. Thus, as in the case of the region D, both of the sum of the portions printed by the forward scanning and the sum of the portions printed by the backward scanning cover the entire inclination width d1807 after the inclination correction.

FIG. 18B shows a ruled line pattern printed in the printing state as described above. Since the displacement in the bidirectional printing exists, each region includes displacement s between the forward scanning and the backward scanning. Thus, printing widths d2101 and d2102 are set further larger than the inclination width d1807 after the inclination correction. However, since such a displacement amount is not changed for each region, no "band unevenness" occurs.

FIGS. 19A and 19B are views showing how the bidirectional printing with six passes is carried out while performing 3-division inclination correction in a state where the printing head having an inclination equivalent to that shown in FIGS. 18A and 18B is used, and where a displacement in the bidirectional printing exists. FIG. 19A is a view showing printing positions of three blocks when the respective blocks are driven while timings therebetween are shifted. In the bidirectional printing with six passes, main scanning and sub-scanning are alternately repeated. Specifically, in the main scanning, ink is discharged while the printing head in the printing state as described above is bidirectionally moved. Moreover, in the sub-scanning, a printing medium is transported by an amount corresponding to an LF width (=H/6) shown in FIG. 19A. Thus, for example, when a printing region D of the printing medium is in focus, in the region, the forward scanning is performed by use of a portion 2401 of a first block, a portion 2403 of a second block and a portion 2405 of a third block, and the backward scanning is performed by use of a portion 2402 of the first block, a portion 2404 of the second block and a portion 2406 of the third block. In the case of this example, the sum of the portions printed by the forward scanning and the sum of the portions printed by the backward scanning each occupy a different half of a region of the inclination width d1808 of the printing head after the inclination correction.

Meanwhile, in a printing region E adjacent to the region D, an image is formed in a state where the forward scanning and the backward scanning are reversed. Specifically, the forward scanning is performed by use of the portion 2402 of the first block, the portion 2404 of the second block and the portion 2406 of the third block, and the backward scanning is performed by use of the portion 2401 of the first block, the portion 2403 of the second block and the portion 2405 of the third block. Thus, the sum of the portions printed by the forward scanning and the sum of the portions printed by the backward scanning each occupy a different half of the region of the inclination width d1808 of the printing head after the inclination correction. However, a region occupied by the sum of the forward scanning and a region occupied by the sum of the backward scanning are in a positional relationship reversed from that in the region D. If the displacement in the bidirectional printing exists in such a state, the printing widths in the regions D and the region E are changed in opposite directions each of increase and reduction. Specifically, when the printing width in the region D is increased, the printing width in the region E is reduced, and when the printing width in the region D is reduced, the printing width in the region E is increased.

FIG. 19B shows a ruled line pattern printed in the printing state as described above. Since the displacement in the bidirectional printing exists, each region includes displacement s between the forward scanning and the backward scanning. Thus, printing widths d2201 and d2202 in the respective regions are set to be different from the width d1808 after the inclination correction. In this event, the printing width d2201 in the region D is larger than the width d1808 after the inclination correction. On the other hand, the printing width d2202 in the region E is smaller than the width d1808 after the inclination correction. As described above, a change in a displacement amount (that is the printing width) between an image formed by the forward scanning and an image formed by the backward scanning for each region causes a difference in a dot dispersion state between the respective regions. Furthermore, since regions having different dispersion states, such as the regions D and E, are alternately disposed in the sub-scanning direction, "band unevenness" occurs.

FIG. 41 is a table collectively showing the results described above with-reference to FIGS. 15A to 19B. It is confirmed that the 3-division correction, which corrects the inclination in a more desirable state, may worsen the "band unevenness" rather than the 2-division correction.

As a result of the keen examination, the inventors of the present invention have recognized the phenomenon described above and discovered that it is required to maintain a predetermined relationship between the number of multi-passes and the number of blocks for inclination correction in a case where the inclination correction is performed in the bidirectional multi-pass printing. Specifically, the inventors of the present invention have determined that, in order to prevent occurrence of the "band unevenness", it is desired to adjust block division for the inclination correction according to the number of multi-passes in the bidirectional printing even if the bidirectional printing is somewhat displaced.

FIGS. 18A and 19A are referred to again to clarify what the aforementioned predetermined relationship is. The reason why the "band unevenness" is avoided in the state of FIG. 18A is because both of the sum of the printing by the forward scanning and the sum of the printing by the backward scanning cover the entire inclination width after the inclination correction. In such a state, even if the sum of the forward scanning and the sum of the backward scanning are reversed, such as the regions D and E, both of the printing regions can maintain a congruent relationship regardless of a displace direction.

As one of conditions for allowing both of the sum of the forward scanning and the sum of the backward scanning to cover the entire inclination width after the inclination correction, there is a condition that "each printing region corresponds to more than one divided blocks". The size of the inclination width after the inclination correction corresponds to an inclination width of each block. Thus, if each printing region includes more than one divided block, printing over the entire inclination width is completed by performing the forward scanning or the backward scanning once.

Moreover, as another condition, there is a condition that "each of divided blocks corresponds to odd printing regions (one printing region is the printing head width H/the number of multi-passes)". In the case of FIG. 18A, each of the first and second blocks, which are obtained by division into two blocks, corresponds to three printing regions. As described above, if the number of printing regions corresponding to each block is an odd number, a positional relationship between a forward scanning region and a backward scanning region, which are alternately disposed, is reversed for each block. Thus, both of the sum of the forward scanning and the sum of the backward scanning can cover the entire inclination region after the inclination correction. Meanwhile, in the case of FIG. 19A, each of the blocks, which are obtained by division into three-blocks, corresponds to two printing regions. In such a case, a positional relationship between the forward scanning region and the backward scanning region, which are alternately disposed, is not reversed for each block. Thus, neither the sum of the forward scanning nor the sum of the backward scanning can cover the entire inclination region after the inclination correction.

Specifically, in order to obtain effects of the present invention, it is required to satisfy any one of the first condition "each printing region corresponds to more than one divided blocks" and the second condition "each of divided blocks corresponds to odd printing regions". A block length after the block division is expressed as a value (H/B) obtained by dividing the printing head width H by the block number B. A width of the printing region is expressed as a value (H/P) obtained by dividing the printing head width H by the multi-pass number P. Thus, the first condition can be expressed as $H/P=N\times H/B$, in other words, $B=N\times P$ (N is an integer of not less than 1). Moreover, the second condition can be expressed as $H/B=N\times H/P$, in other words, $P=M\times B$ (M is an odd number of not less than 1). In FIG. 23, spots, which satisfy the foregoing conditions, are indicated by circles.

A recent general ink jet printing apparatus often includes means for adjusting a displacement in a bidirectional printing. The printing apparatus is designed to reduce problems with images, such as "graininess" and "ruled line displacement", as much as possible. However, a slight displacement in the bidirectional printing as described above is a phenomenon likely to occur suddenly due to various factors such as deformation of the printing medium, a variation in a movement speed of the printing head and an ink discharge state of the printing head. Moreover, the inventors of the present invention recognize that the adverse effect of the "band unevenness" described above is an item, which significantly deteriorates image quality, even if the "band unevenness" is a sudden phenomenon. However, in the conventional inclination correction as described in the foregoing patent documents, the division number in the inclination correction is set regardless of the multi-pass number. Thus, it is difficult to avoid the aforementioned "band unevenness".

SUMMARY OF THE INVENTION

The present invention can solve the foregoing problems. The present invention can provide a printing apparatus and an inclination correction method for correcting an inclination of a printing position in a state where "band unevenness" is suppressed as much as possible even if a bidirectional printing is somewhat displaced when bidirectional multi-pass printing is carried out by use of a printing head having an inclination.

The first aspect of the present invention is a printing apparatus which forms an image on a printing medium by alternately repeating print main scanning, in which a printing element array including a plurality of printing elements arranged in a predetermined direction is moved in a direction intersecting the predetermined direction, and sub-scanning, in which the printing medium is transported in a direction intersecting the print main scanning, the printing elements applying a printing agent onto the printing medium according to image data, comprising: means for acquiring inclination information on the printing element array; means for acquiring a printing mode for the image data to be printed; means for setting a division number B (an integer of not less than 1) for dividing the plurality of printing elements into a plurality of blocks, and timings at which each of the plurality of blocks are driven, on the bases of the inclination information and the printing mode; and means for driving the plurality of printing elements on the bases of the division number B and the timings.

The second aspect of the present invention is an inclination correction method for a printing apparatus which forms an image on a printing medium by alternately repeating print main scanning, in which a printing element array including a plurality of printing elements arranged in a predetermined direction is moved in a direction intersecting the predetermined direction, and sub-scanning, in which the printing medium is transported in a direction intersecting the print main scanning, the printing elements applying a color material onto the printing medium according to image data, comprising the steps of: acquiring inclination information on the printing element array; acquiring a printing mode for the image data to be printed; setting a division number B (an integer of not less than 1) for dividing the plurality of printing elements into a plurality of blocks, and timings at which each of the plurality of blocks are driven, on the bases of the inclination information and the printing mode; and driving the plurality of printing elements on the bases of the division number B and the timings.

The above and other objects, effects, features and advantages of the present invention will become more apparent from the following description of embodiments thereof taken in conjunction with the accompanying drawings.

BRIEF DESCRIPTION OF THE DRAWINGS

FIG. 23 is a view for explaining a suitable relationship between the number of block divisions and the number of multi-passes for correcting an inclination of a printing head in bidirectional multi-pass printing;

FIG. 25 is a view showing a relationship between a block and a data displacement amount;

FIG. 41 is a table collectively showing image results obtained by 2-division printing and 3-division printing.

DETAILED DESCRIPTION OF PREFERRED EMBODIMENTS

With reference to the drawings, embodiments of the present invention will be described below.

Figure 20:
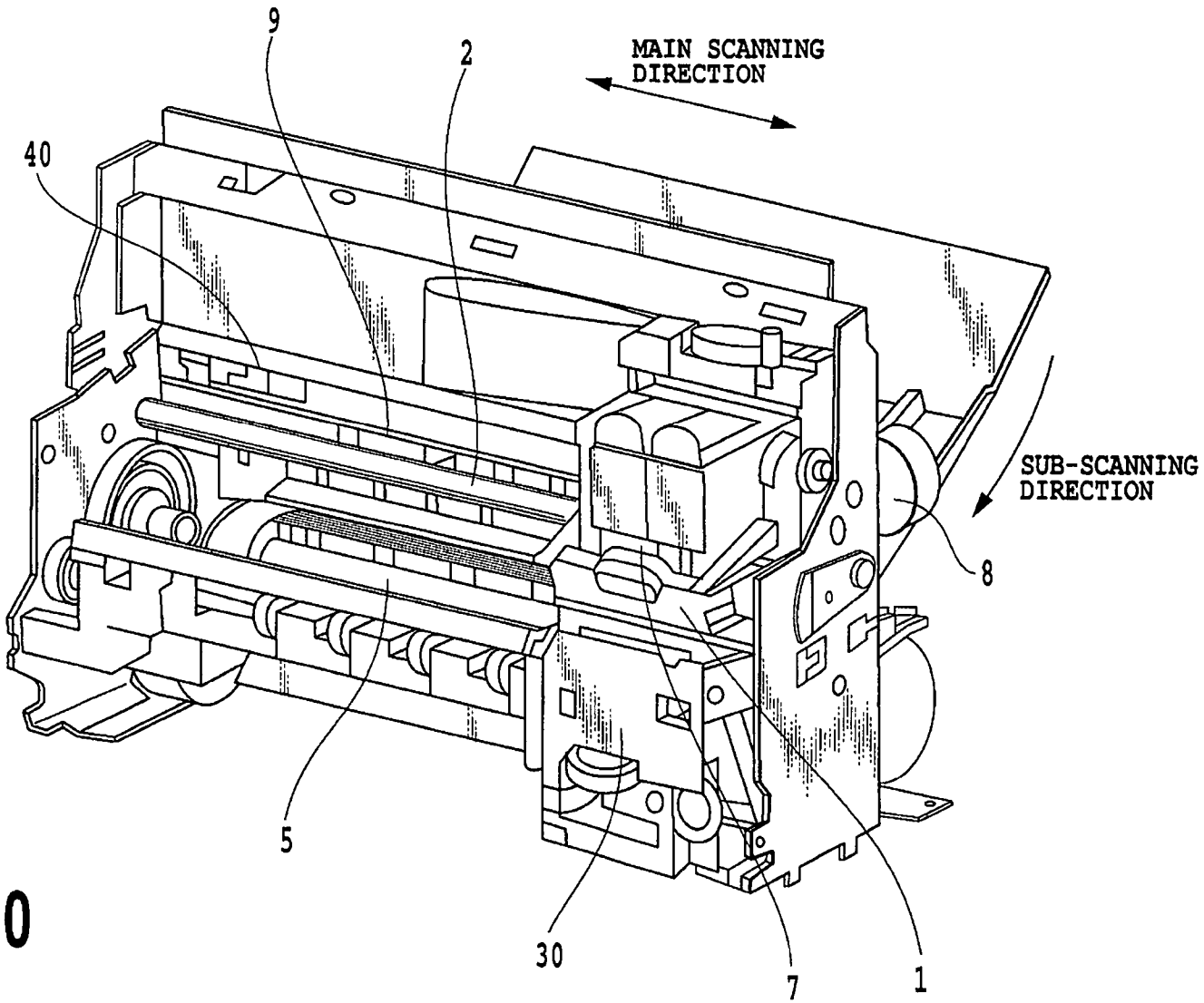
FIG. 20 is a perspective view for explaining an internal mechanism of an ink jet printing apparatus applicable to the present invention.

FIG. 20 is a perspective view for explaining an internal mechanism of an ink jet printing apparatus applicable to the present invention. In FIG. 20, reference numeral 1 denotes a carriage mounting a printing head 7. The carriage 1 is supported by a guide shaft 2 and an unillustrated guide rail, and is movable in a main scanning direction shown in FIG. 20 by a driving force, which is transmitted through a belt 9, of a carriage motor 8. A printing medium is transported in a sub-scanning direction by rotation of an LF roller 5. Moreover, a region facing movement and scanning of the printing head 7 is supported from below by an unillustrated platen.

When printing is performed, the carriage 1 is moved at a predetermined speed, and concurrently, the printing head 7 discharges ink on the basis of printing data. Thus, an image for one print main scanning is formed on the printing medium. When the one print main scanning is finished, the printing medium is transported for a predetermined amount in the sub-scanning direction by the rotation of the LF roller 5. By intermittently repeating the print main scanning and the transportation operation as described above, an image is sequentially formed on the printing medium.

At a home position provided outside a printing region within a range of scanning by the carriage 1, a pump base 30 for performing maintenance of the printing head 7 is provided. When printing is not performed for a long period of time, such as when a power of the printing apparatus is turned off, the carriage 1 is returned to the home position, and a discharge surface is capped with capping means provided in the pump base 30. Such capping makes it possible to suppress evaporation of the ink from discharge ports. Moreover, discharge performance of the printing head 7 is maintained by performing various recovery operations such as sucking the ink from the discharge ports by the pump base 30 and wiping discharge port surfaces by an unillustrated wiper.

Figure 21:
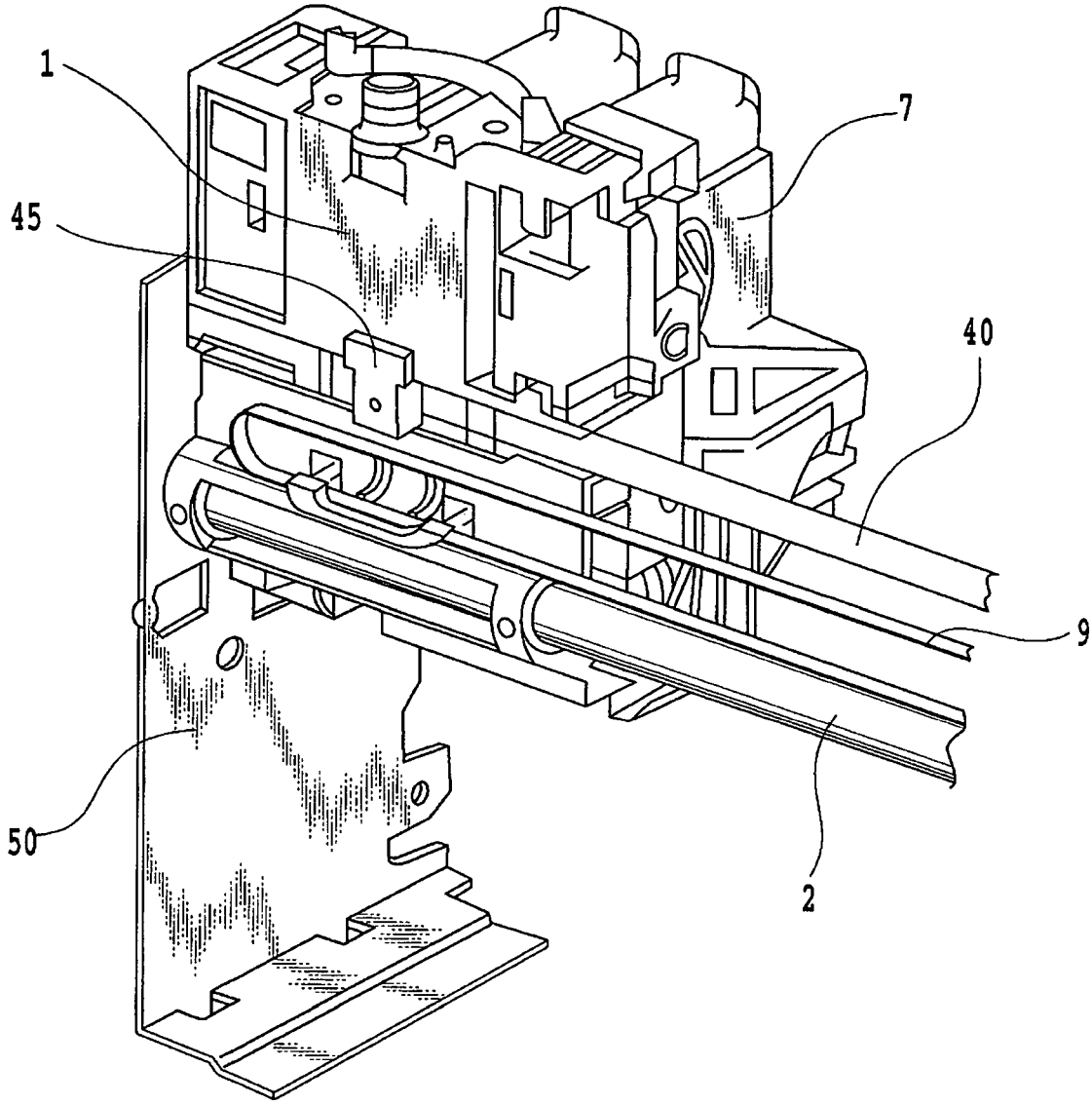
FIG. 21 is a perspective view for explaining a drive mechanism of a carriage.

FIG. 21 is a perspective view for explaining a drive mechanism of the carriage 1. The guide shaft 2 is fixed to a chassis 50, and serves as a guide for reciprocating movement of the carriage 1. The belt 9 wound and suspended in the main scanning direction is connected to the carriage motor 8 fixed to the chassis 50, and is fixed to the carriage 1. Thus, rotation of the carriage motor 8 is converted into the reciprocating movement of the carriage 1. An encoder scale 40 marked at a fixed pitch is held in the main scanning direction within the chassis while having predetermined tension.

On the encoder scale 40, marks are given, for example, at intervals of 300 LPI (line/inch), that is, 25.4 mm/300=84.6 μm. By detecting the marks by use of an encoder sensor 45 fixed to the carriage 1, a current position of the carriage 1 can be accurately acquired. An optical method or a magnetic method is applicable as a method for detection by the encoder sensor.

Positional information obtained by the encoder is used for controlling a timing of discharge by the printing head 7. Moreover, from a time interval of continuous detection of the marks given on the encoder scale 40, a movement speed of the carriage 1 can also be calculated.

Figure 22:
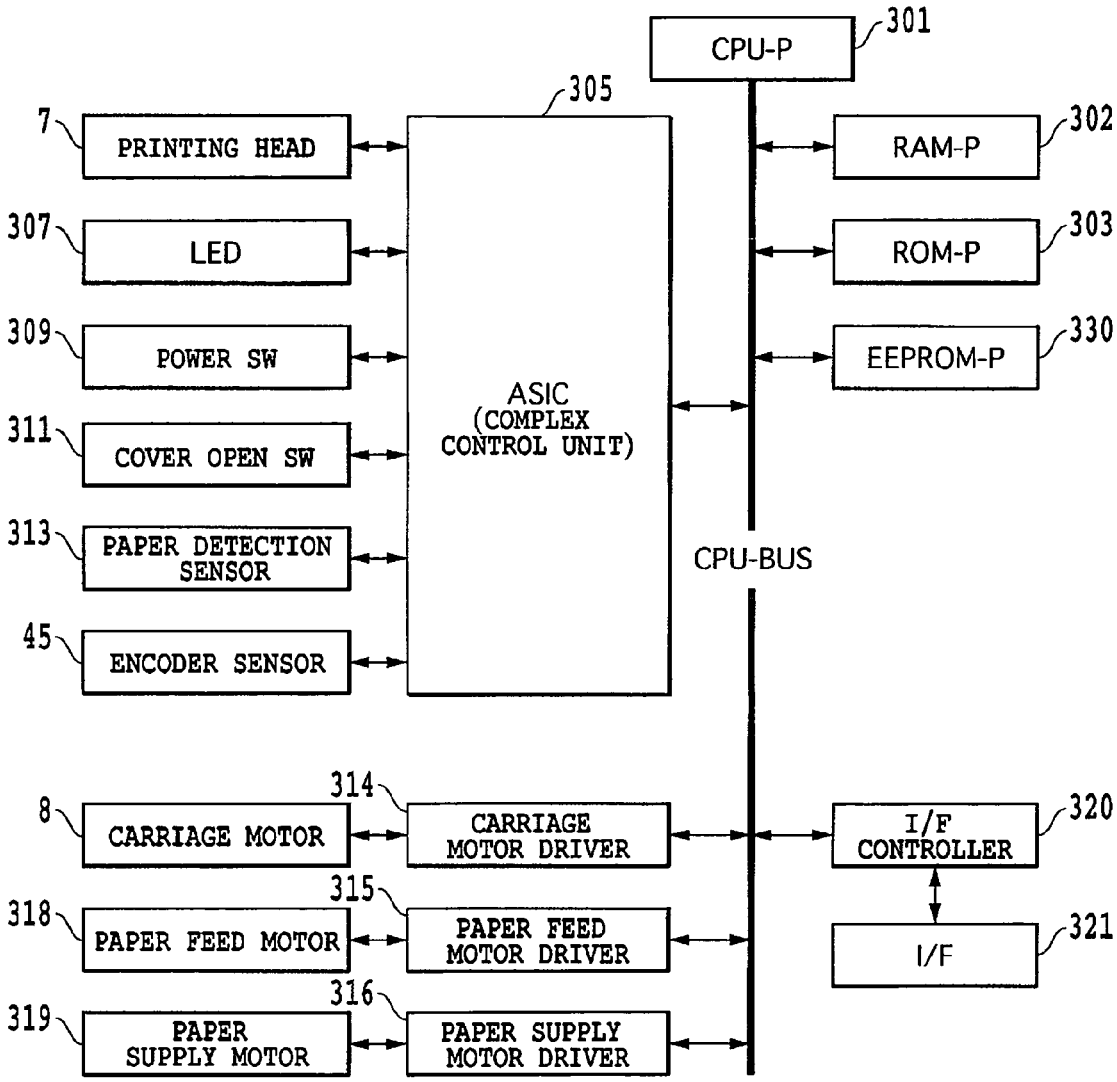
FIG. 22 is a block diagram showing a control configuration of the ink jet printing apparatus of this embodiment.

FIG. 22 is a block diagram showing a control configuration of the ink jet printing apparatus of this embodiment.

Reference numeral 301 denotes a CPU-P (central processing unit) for controlling the entire printing apparatus. The CPU-P 301 controls the entire printing apparatus according to control programs in a ROM-P 303. For example, the CPU-P 301 performs rotation control of three motors (the carriage motor 8, a paper feed motor 318 and a paper supply motor 319) through motor drivers 314 to 316, and printing control corresponding to a printing command by transferring printing data to the printing head 7 through a complex control unit (ASIC) 305. Specifically, the rotation control and the printing control described above are performed on the bases of various instruction signals and a printing command. The instruction signals are inputted through the complex control unit 305 from two sensors (the encoder sensor 45 and a paper detection sensor 313) and from various switches (a power SW 309, a cover open SW 311 and the like), which are provided on an operation panel. The printing command is read from an I/F controller 320, and which is sent to an interface 321 from a host device.

Reference numeral 302 denotes a RAM-P (printing apparatus RAM: temporary memory), which is used as: a receiving buffer for temporarily storing expanded data for printing and the data (the printing command or the printing data) received from the host; a work memory for storing necessary information such as a printing speed; a work area for the CPU-P 301; and the like.

Reference numeral 303 denotes a ROM-P (printing apparatus ROM: read-only memory), which stores: a printing control program executed by the CPU-P 301 to perform printing by transferring the printing data to the printing head 7; a program for controlling the carriage 1 and paper feed; a printing apparatus emulation program; a printing font; and the like.

Reference numeral 305 denotes a complex control unit (ASIC), which has functions of: detecting the printing head 7, turning ON/OFF and blinking of a power LED 307, the power SW 309 and the cover open SW 311; detecting the paper detection sensor 313; and the like.

Reference numerals 314 to 316 denote motor drivers for controlling drive of the respective motors. The carriage motor 8, the paper feed motor 318 and the paper supply motor 319 are motors connected to the motor drivers. The drive of the respective motors is controlled by the motor drivers according to an instruction from the CPU-P.

As the carriage motor 8, a DC servo motor for performing servo control is used. As the paper feed motor 318 and the paper supply motor 319, stepping motors easily controlled by the CPU-P 301 are used.

Reference numeral 320 denotes an I/F controller, which is connected to the host device, such as a computer, through the I/F (interface) 321. The I/F 321 is a bidirectional interface which receives the printing command and the printing data, which are transmitted from the host device, and transmits error information and the like, on a printing apparatus side. As the I/F 321, various interfaces are used, such as a centrointerface and a USB interface.

Reference numeral 330 denotes a nonvolatile electrically erasable and programmable read only memory EEPROM for storing each resist adjusted value, the number of sheets of paper to be printed, the number of dots formed by discharge in printing, the number of times of changing an ink tank, the number of times of changing the printing head, the number of times of executing a cleaning operation instructed by a user, and the like. The contents written therein are retained even if the power is turned off.

By use of the above-described printing apparatus shown in FIGS. 20 to 22, concrete description will be given for an inclination correction method for a printing head having an inclination.

FIG. 23 is a view for explaining a suitable relationship between the number of block divisions (B) and the number of multi-passes for correcting an inclination of a printing head in bidirectional multi-pass printing. Here, according to the examination and study done by the inventors of the present invention, circles are marked for combinations in which "band unevenness" as described in the section of the related art does not occur, and crosses are marked for combinations in which the band unevenness obviously occurs.

Figure 18A:
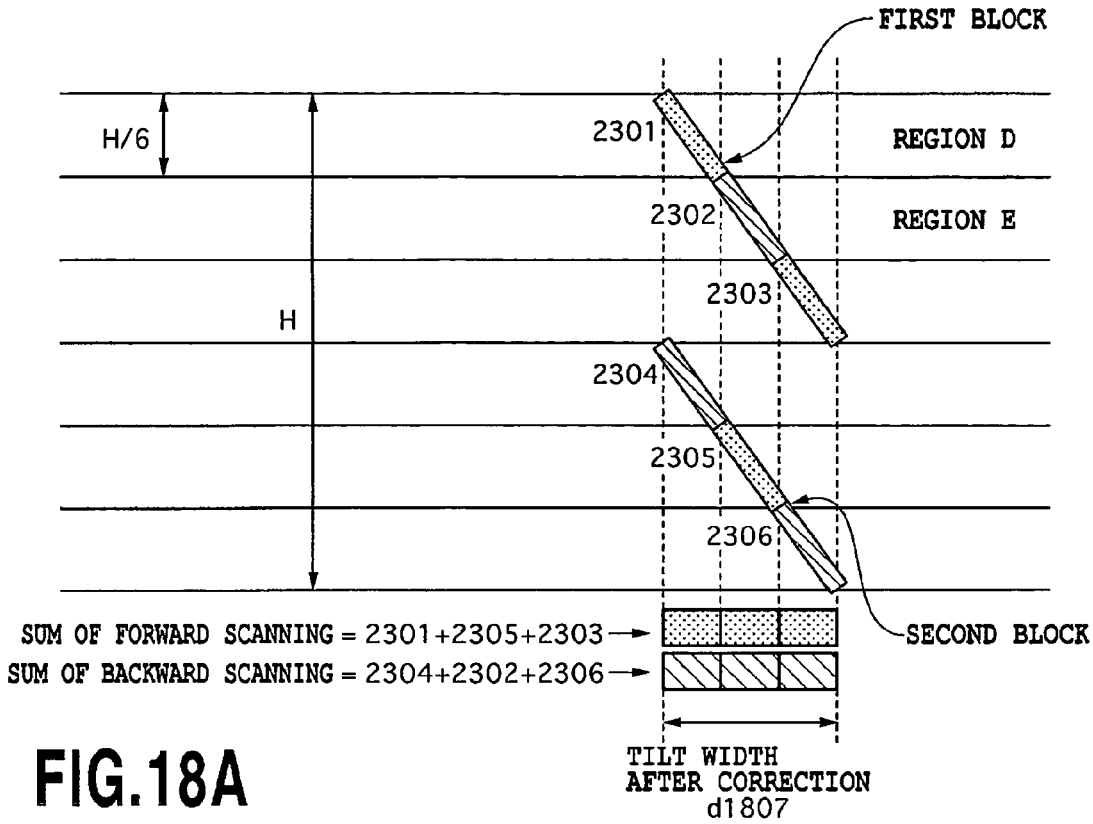
FIGS. 18A and 18B are views showing how the bidirectional printing with six passes is carried out while 2-division inclination correction is performed in a state where the printing head having an inclination is used, and where a displacement in the bidirectional printing exists.
Figure 18B:
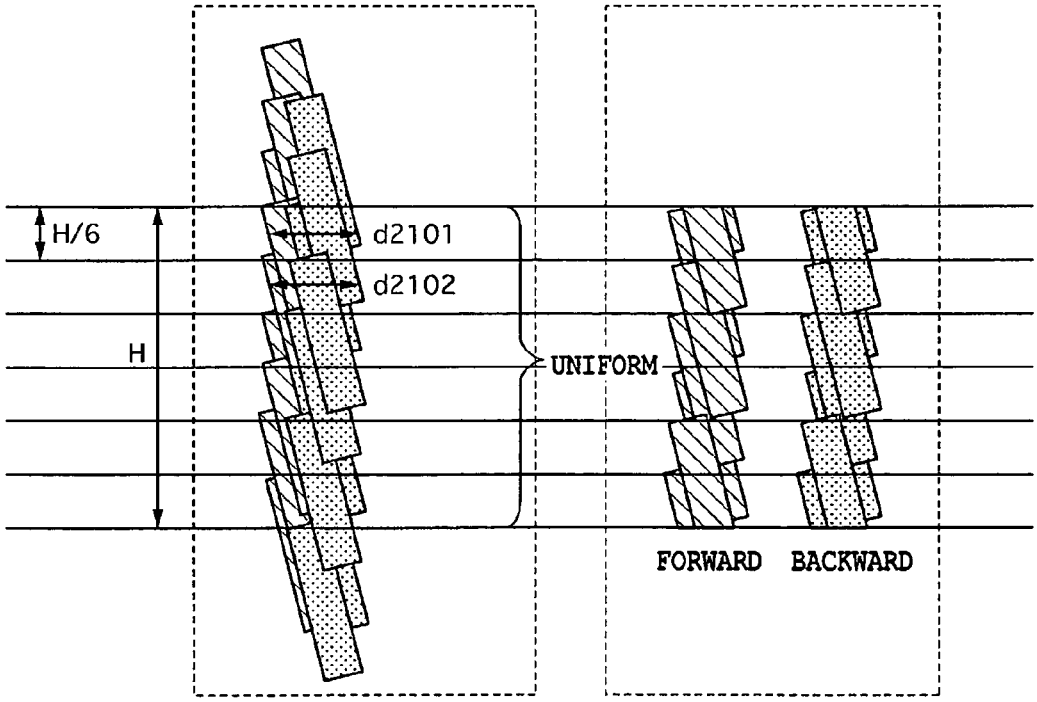
Figure 19A:
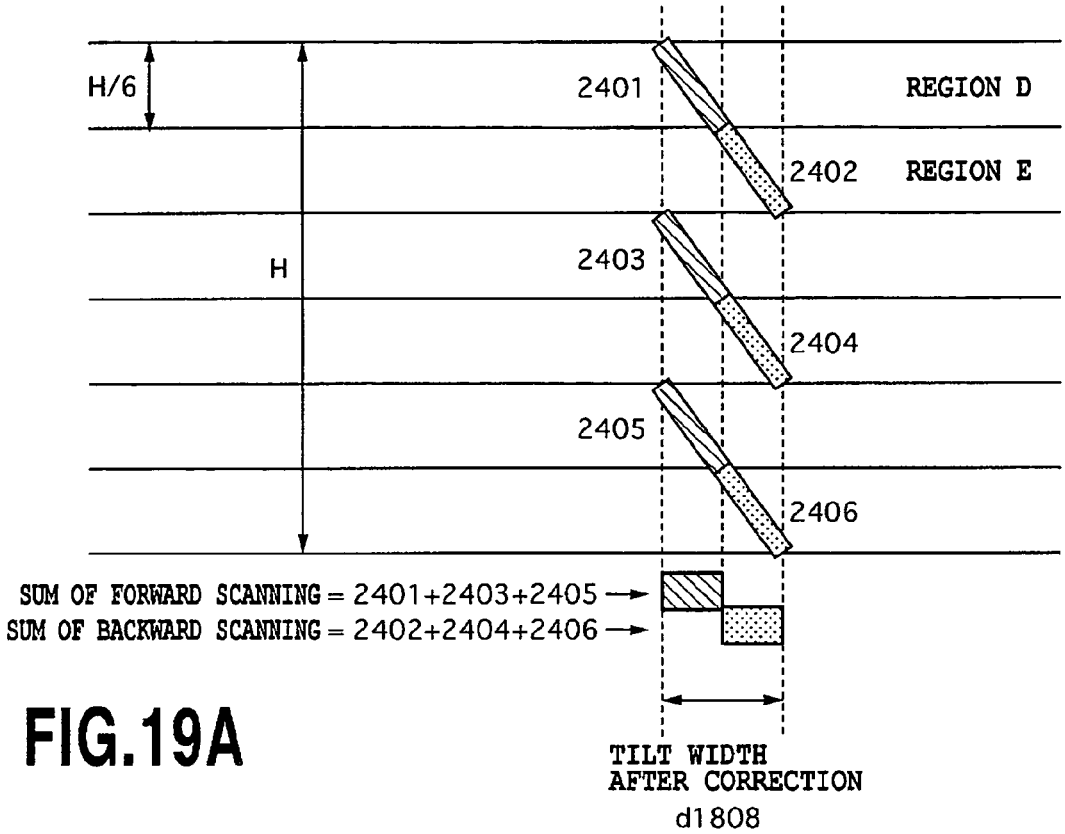
FIGS. 19A and 19B are views showing how the bidirectional printing with six passes is carried out while performing 3-division inclination correction in a state where the printing head having an inclination equivalent to that shown in FIGS. 18A and 18B is used, and where a displacement in the bidirectional printing exists.
Figure 19B:
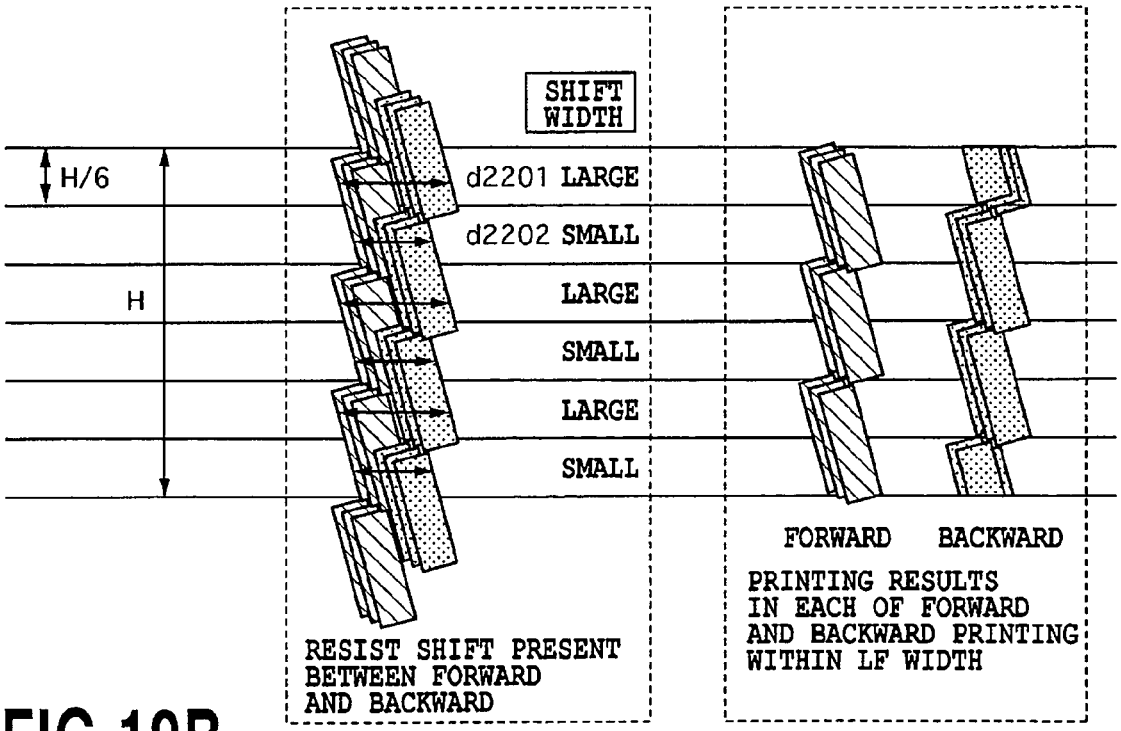

A condition which satisfies the state marked by the circle is as follows. Specifically, as described in FIG. 18A, both of a sum of printing positions in forward scanning and a sum of printing positions in backward scanning cover the entire inclination width after correction. Meanwhile, as to a region marked by the cross, as described in FIG. 19A, both of the sum of the printing positions in the forward scanning and the sum of printing positions in the backward scanning occupy in a part of an inclination width after correction, and do not overlap with each other.

Thus, in this embodiment, a block division method for inclination correction is adjusted according to the number of multi-passes (P) in a printing mode to be executed. The inclination correction method of this embodiment will be concretely described below. Note that, as described in Japanese Patent Application Laid-open No. 11-240143 (1999), the inclination correction in this embodiment has a configuration in which printing data corresponding to printing elements is shifted in the main scanning direction. Thus, a minimum unit of correction is set to be 1 pixel.

Figure 24:
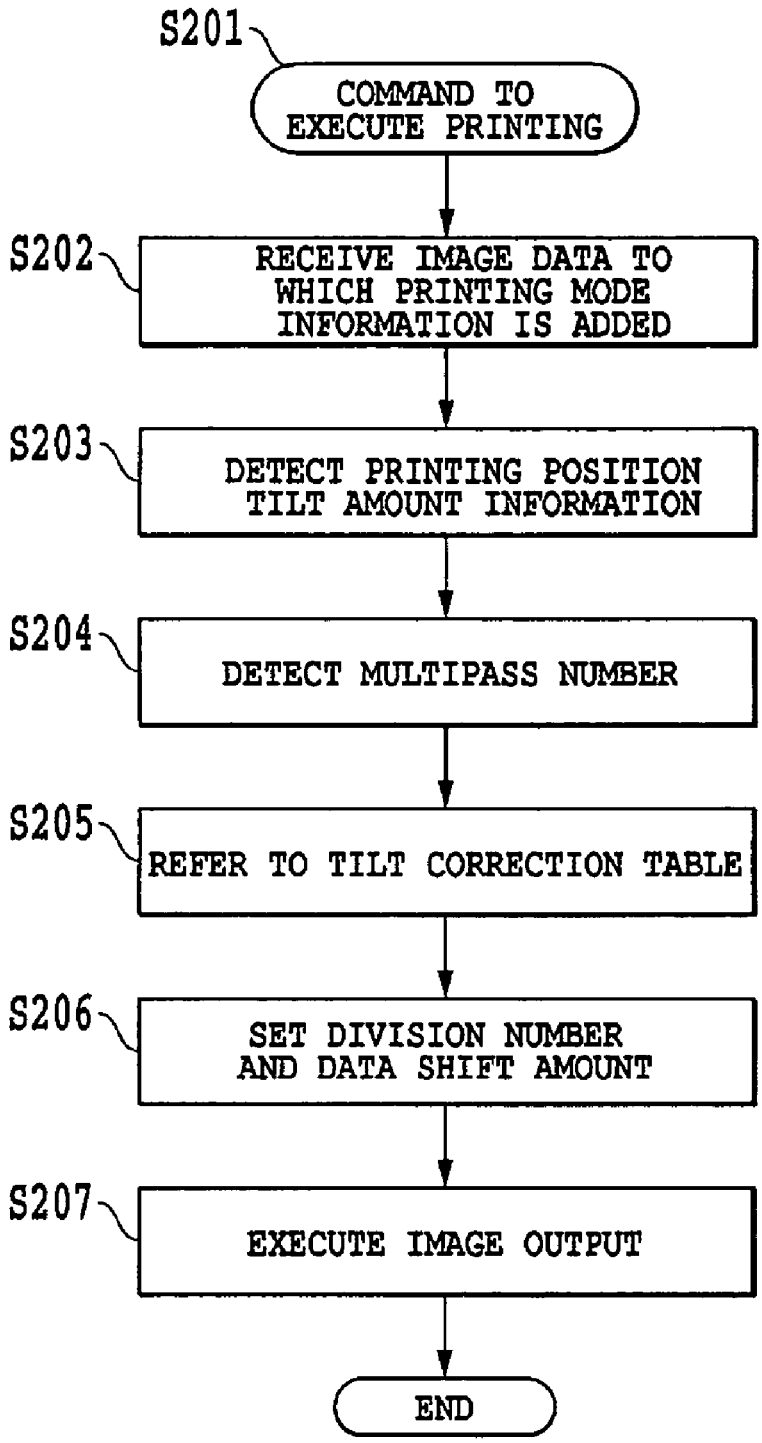
FIG. 24 is a flowchart for explaining a step of setting an inclination correction amount.

FIG. 24 is a flowchart for explaining a step of setting an inclination correction amount prior to printing of an actual image. After a command to execute printing is inputted in Step S201, the CPU-P 301 first receives image data inputted (Step S202).

In Step S203, an inclination amount of a printing position is obtained. More specifically, the inclination amount is obtained by reading inclination information, which is previously stored in the EEPROM-P 330 in the printing apparatus, by the CPU-P 301. In this embodiment, it is assumed that, besides the actual printing mode, an inclination acquisition mode for acquiring inclination information of the printing head is prepared. The inclination acquisition mode has a step of outputting a test pattern for measuring the inclination amount, detecting an inclination degree of the test pattern by a user or detection means included in the printing apparatus, and storing the detection information in the EEPROM-P 330 in the printing apparatus.

In Step S204, the number of multi-passes designated for printing an image is acquired from the information received in Step S202. In the information received in Step S202, information, such as a type of printing medium, whether a color mode is selected, the number of multi-passes, and a print scanning direction (either one-way printing or bidirectional printing), is provided prior to actual image data. The CPU-P 301 extracts information on the number of multi-passes from such information.

Subsequently, in Step S205, by referring to a two-dimensional table stored in the ROM-P 303 in the printing apparatus, a proper number of block divisions for inclination correction and a shift amount of data for each block after division are acquired on the bases of the number of multi-passes acquired in Step S204 and the information on the inclination amount acquired in Step S203.

For example, a case where the number of multi-passes acquired in Step S204 is 6 passes, and where the inclination amount acquired in Step S203 is 2 pixels, is considered. With reference to FIG. 23, in multi-pass printing with 6 passes, an applicable number of block divisions is 2 and 6. Moreover, since the minimum unit of inclination correction in the printing apparatus of this embodiment is 1 pixel, it suffices that 2-division printing, in which the second block is shifted by 1 pixel, be performed in the case of correcting the inclination amount of about 2 pixels (see FIG. 25). The table referred to in Step S205 has contents, which make it possible to acquire the number of block divisions and the data shift amount of each block as described above, based on the number of multi-passes and the inclination amount.

In Step S207, multi-pass printing of an actual image is executed by use of the number of multi-passes acquired in Step S204 on the bases of the number of block divisions and the shift mount, which are obtained in Step S206. This is the end of this processing.

Description will be given below for cases where inclination correction is performed by taking, as examples, various combinations of an array pitch of printing elements, an inclination amount and the number of multi-passes. As a first example, description will be given for a case where bidirectional printing with 6 passes is performed by use of a printing head in which 192 printing elements are arranged at a pitch of 600 dpi. In this event, an inclination amount of the printing head is set to 2 pixels (84 μm). Specifically, positions of dots, which are printed by two printing elements positioned on both ends of the printing element array, are displaced by 2 pixels in the main scanning direction. Under the conditions described above, inclination correction is realized by 2-division printing in which the second block is shifted by 1 pixel.

Figure 26:
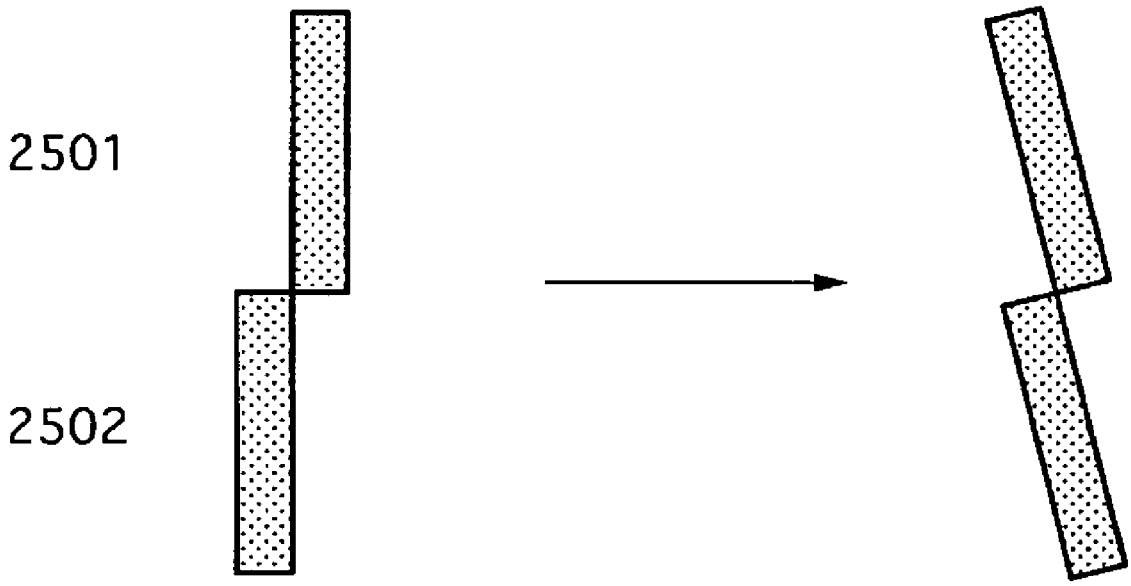
FIG. 26 is a schematic view for explaining an inclination correction state of the printing head.

FIG. 26 is a schematic view for explaining an inclination correction state of the printing head of this example. The printing head is driven in a manner where data in a second block 2502 is shifted by 1 pixel from a first block 2501 (shown on the left side of FIG. 26). In a state where the printing head is inclined, an image is printed in a state shown on the right side of FIG. 26.

Figure 1:
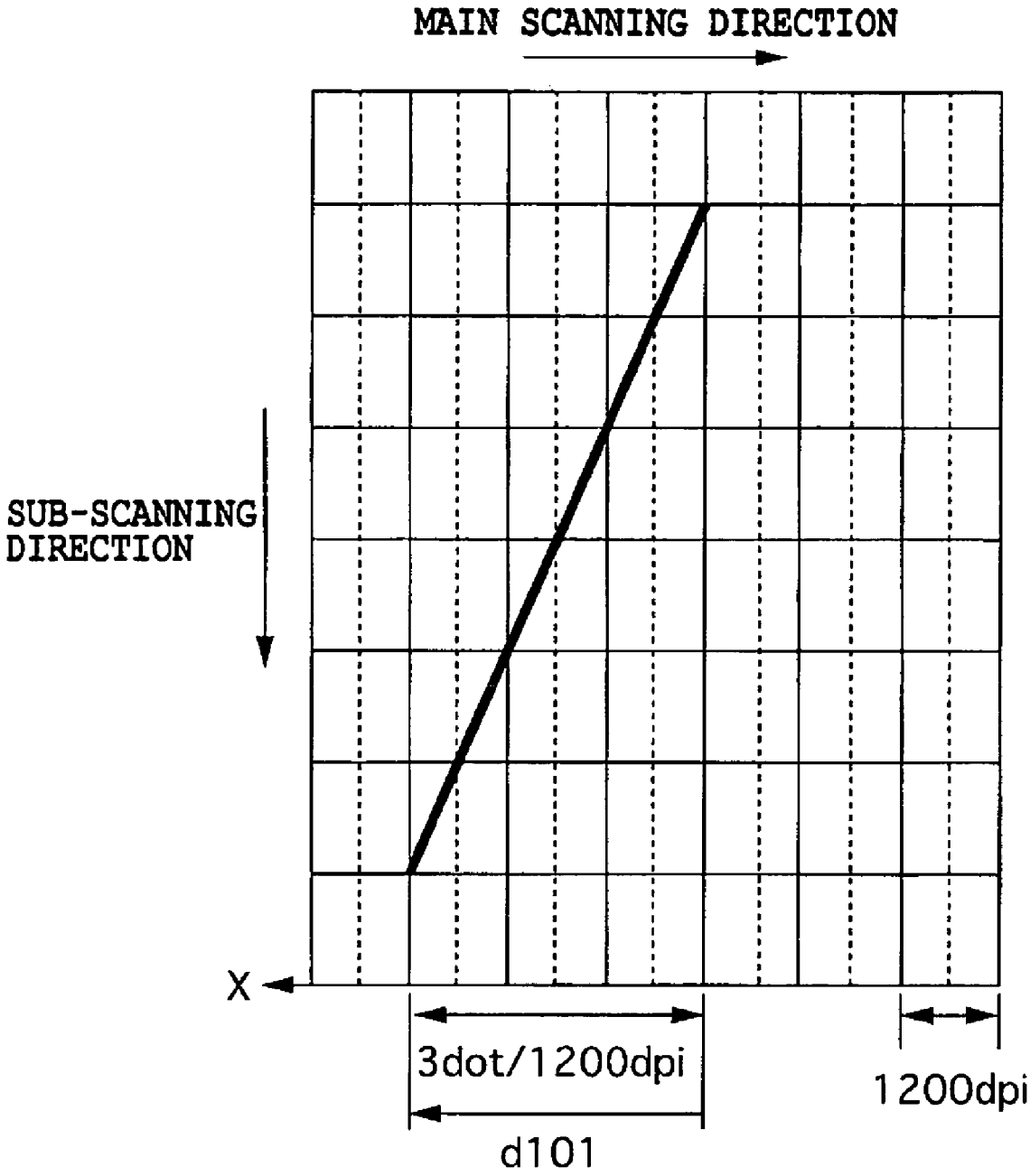
FIG. 1 is a view for explaining an inclination of a printing head.
Figure 2:
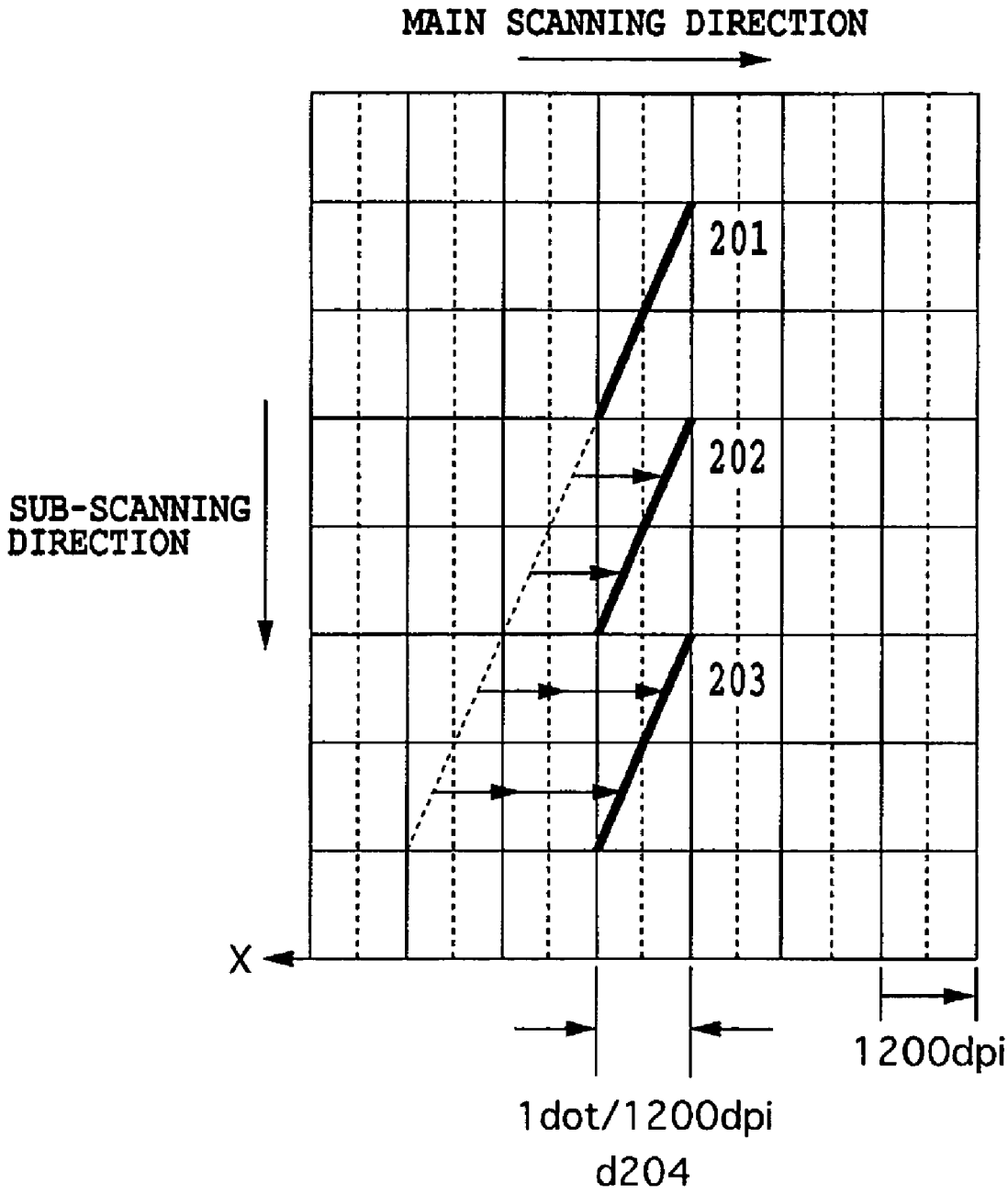
FIG. 2 shows an example of a general inclination correction.
Figure 3:
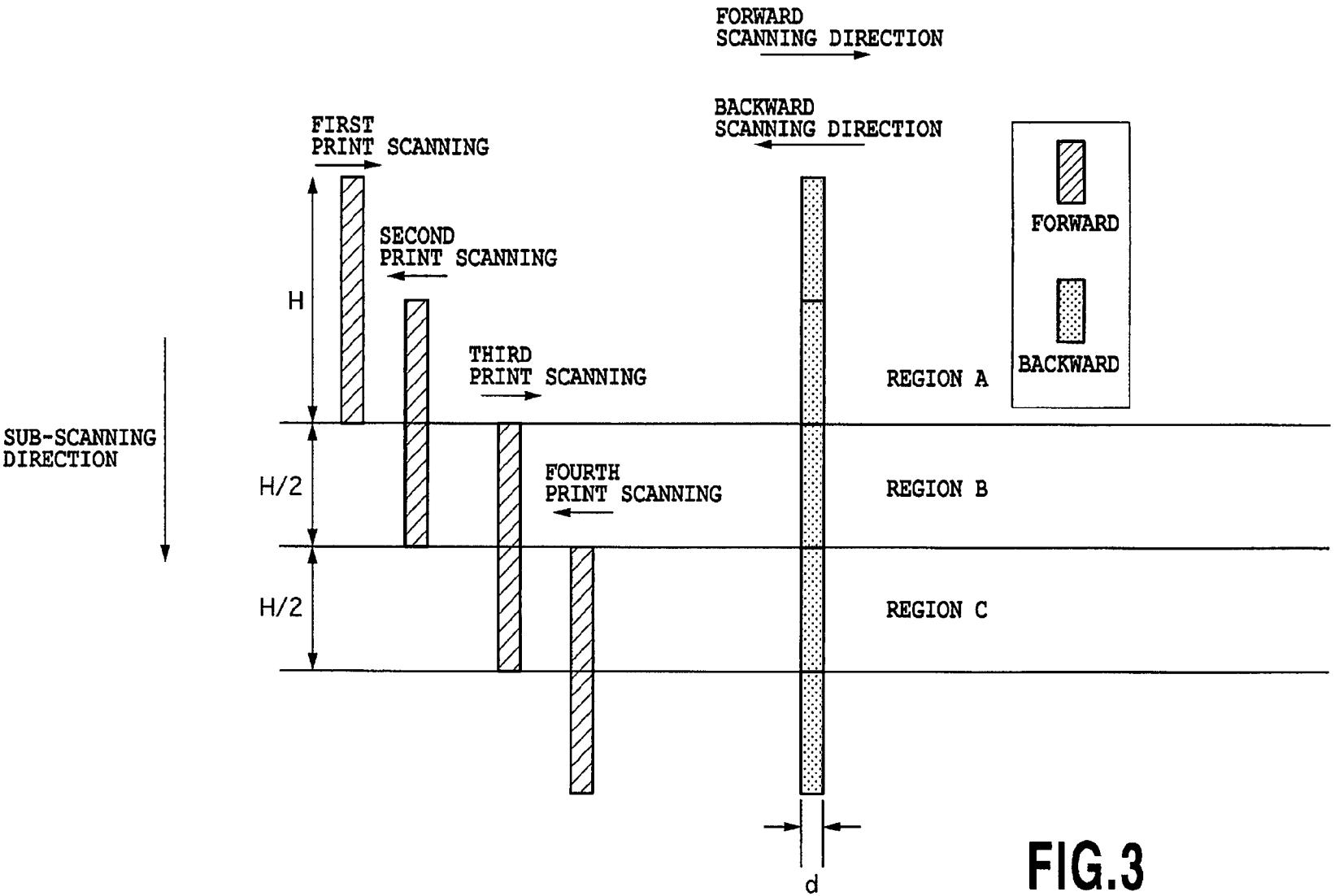
FIG. 3 is a view showing a state where ruled lines are printed by bidirectional printing with two passes by use of a printing head having no inclination when no displacement in a bidirectional printing exists.
Figure 4:
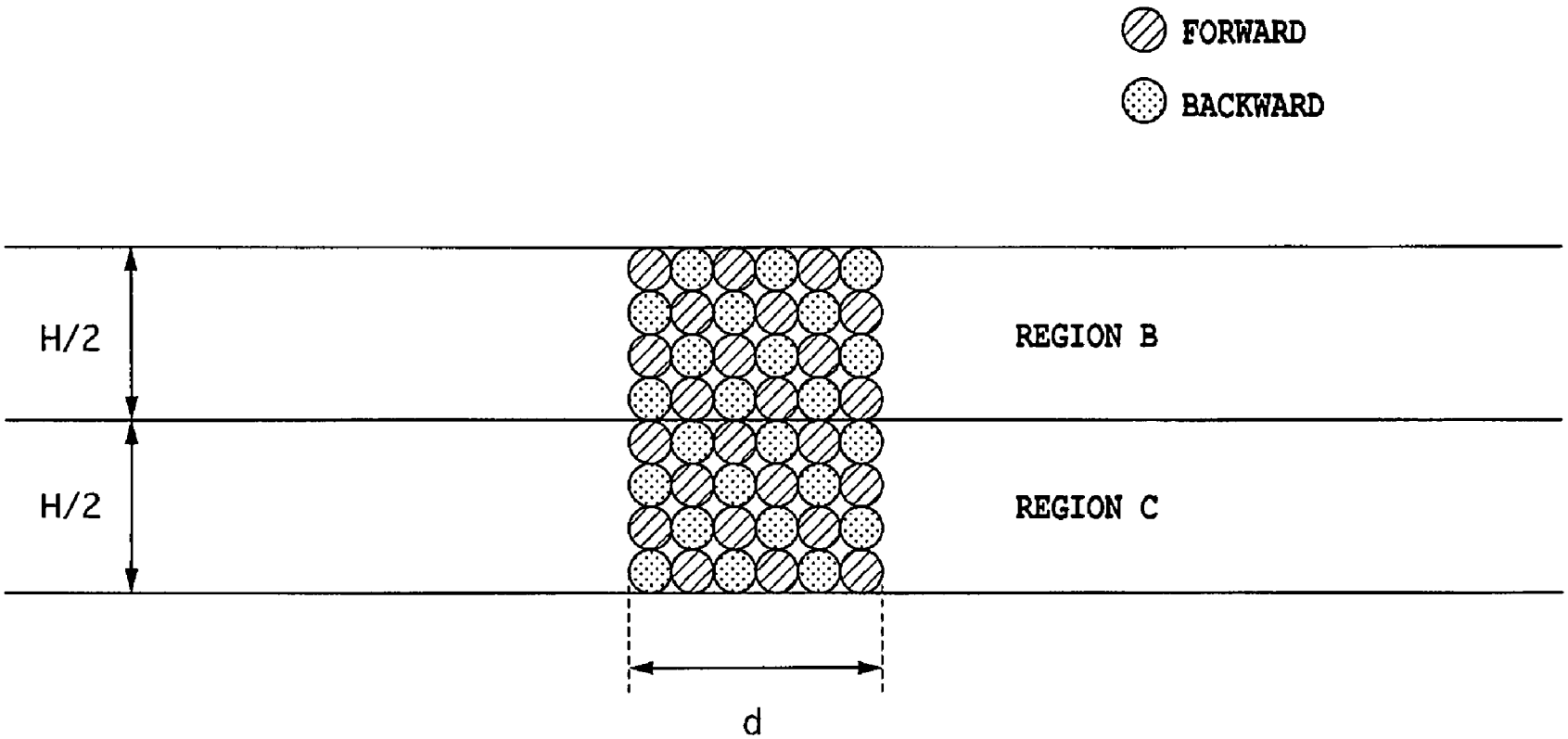
FIG. 4 is an enlarged schematic view for explaining states of dots printed in the respective regions.
Figure 5:
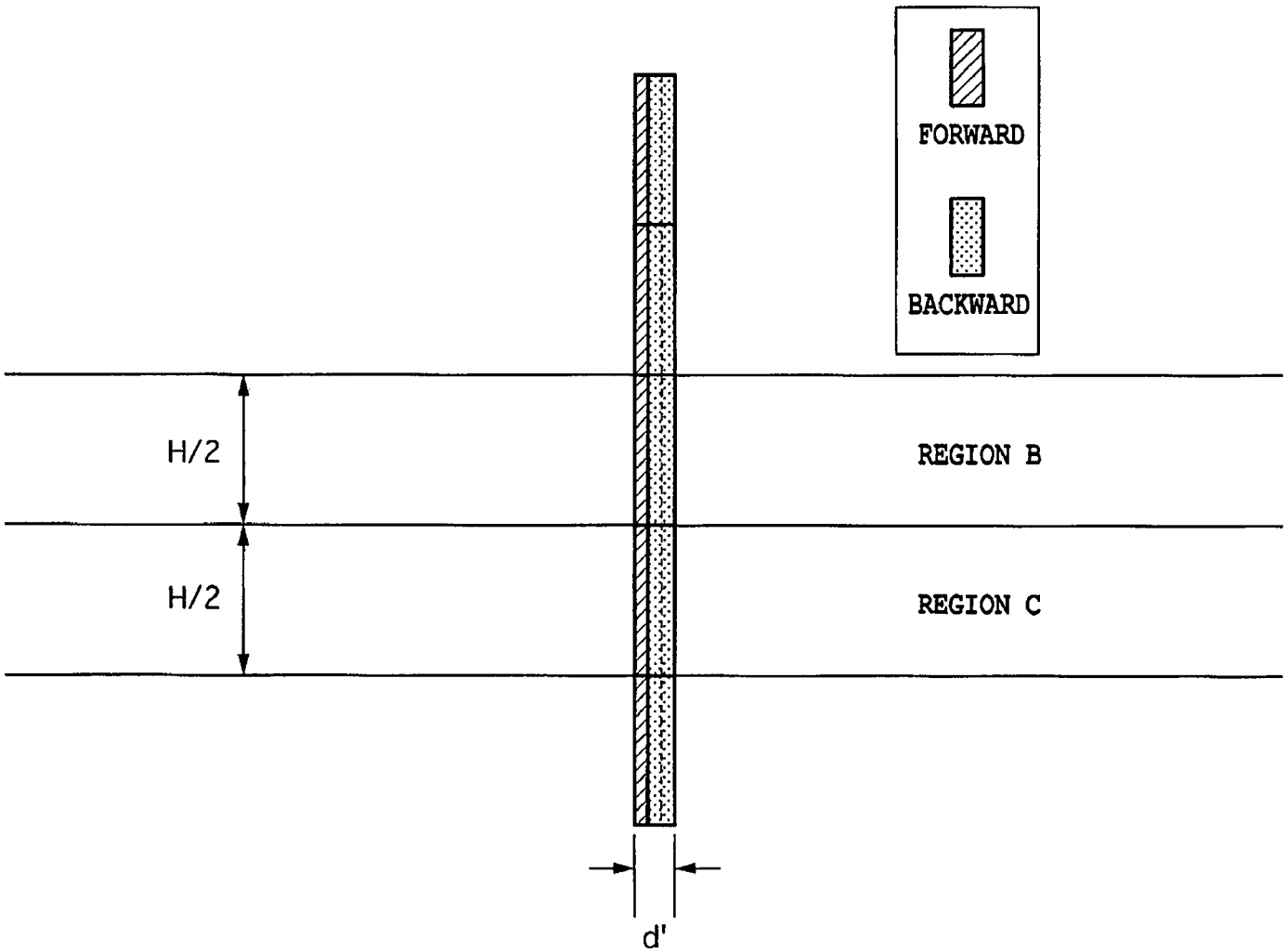
FIG. 5 is a view showing ruled lines formed by the bidirectional printing with two passes by use of the printing head having no inclination when a displacement in the bidirectional printing exists.
Figure 6:
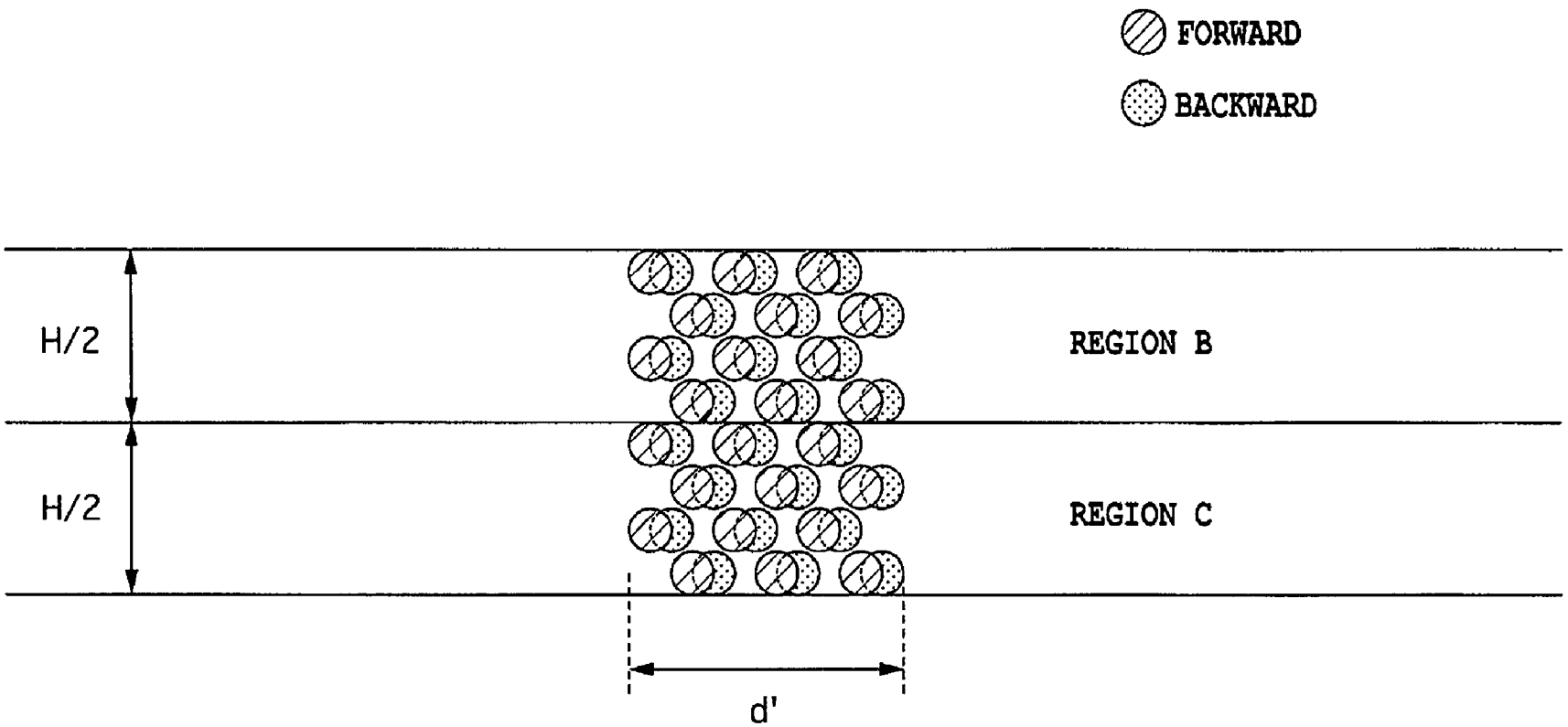
FIG. 6 is an enlarged schematic view for explaining states of dots printed in the respective regions.
Figure 7:
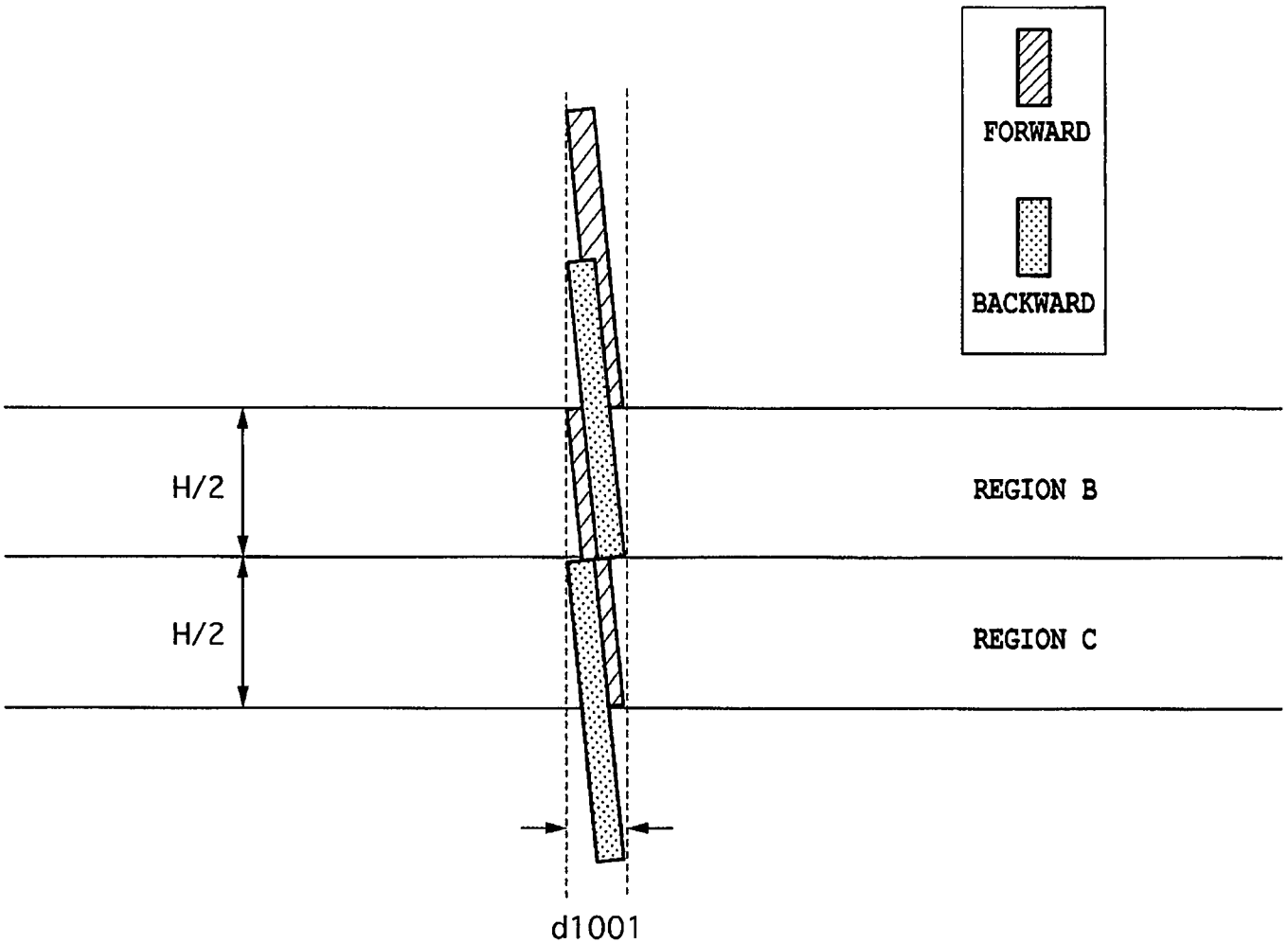
FIG. 7 is a view showing ruled lines formed by the bidirectional printing with two passes by use of a printing head having an inclination when no displacement in the bidirectional printing exists.
Figure 8:
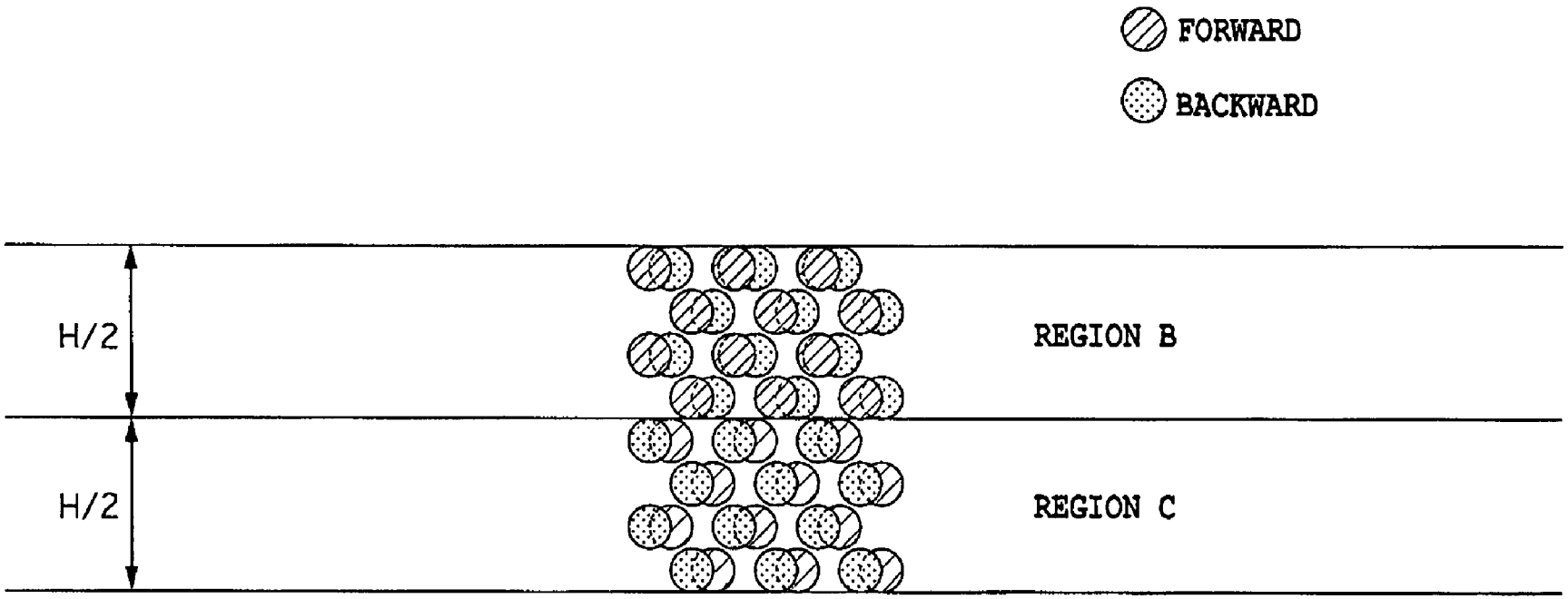
FIG. 8 is an enlarged schematic view for explaining states of dots printed in the respective regions.
Figure 9:
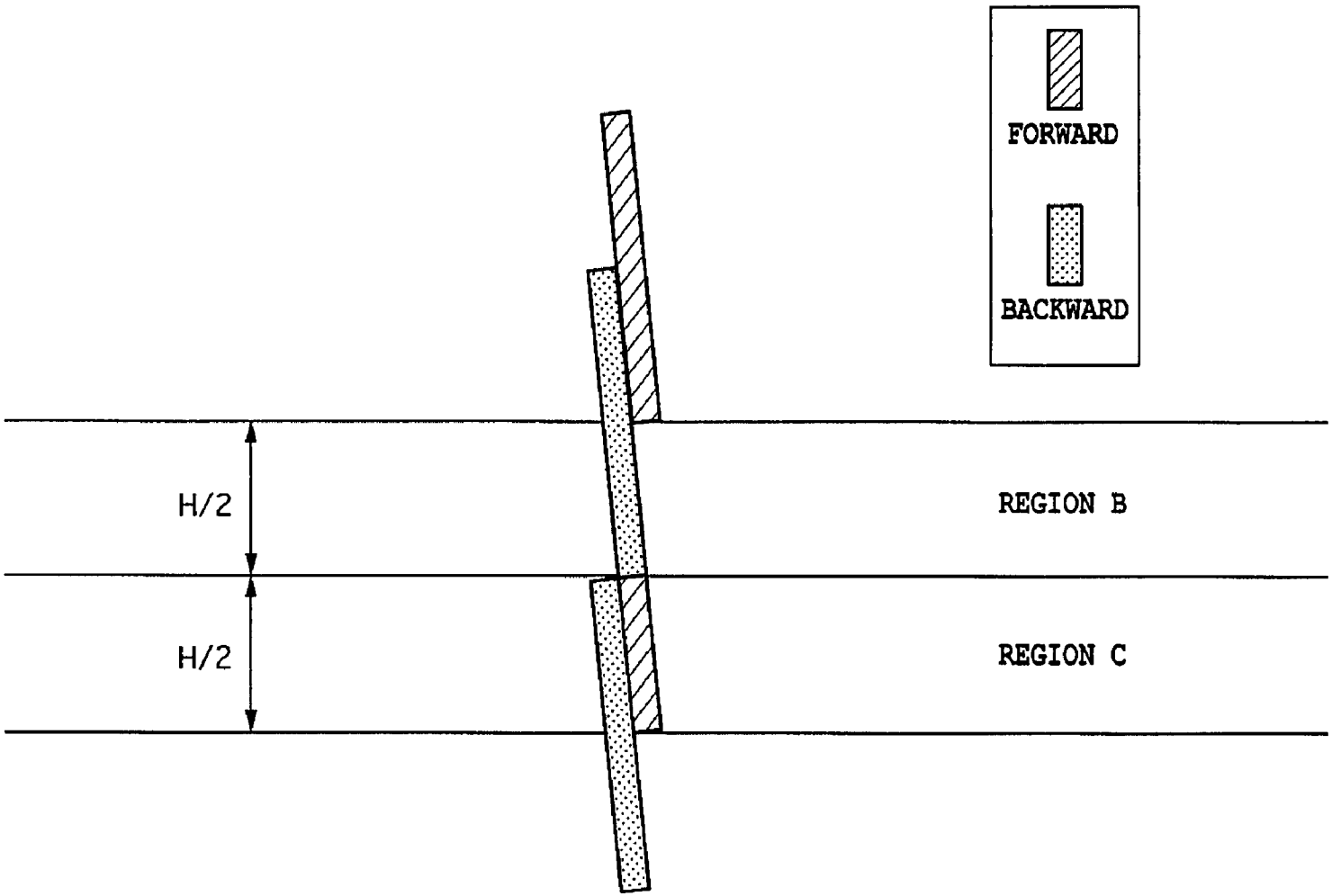
FIG. 9 is a view showing ruled lines formed by the bidirectional printing with two passes by use of the printing head having an inclination when a displacement in the bidirectional printing exists.
Figure 10:
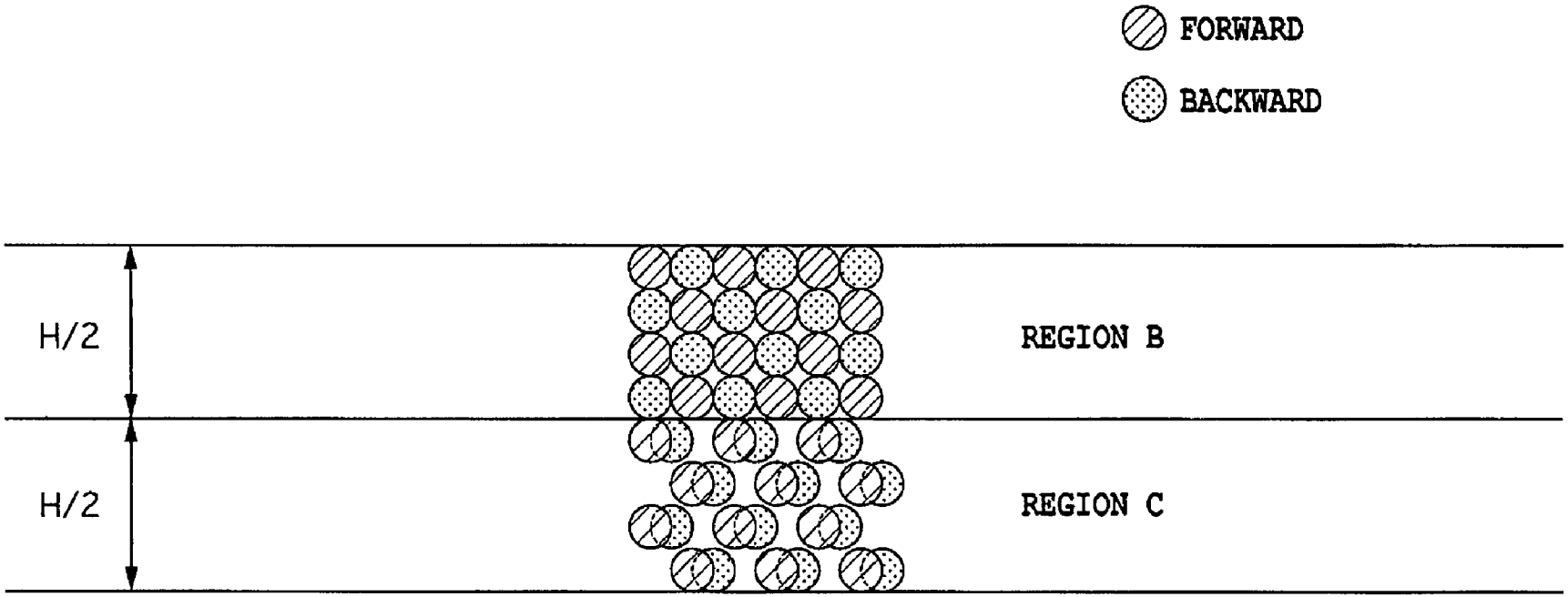
FIG. 10 is an enlarged schematic view for explaining states of dots printed in the respective regions.
Figure 11:
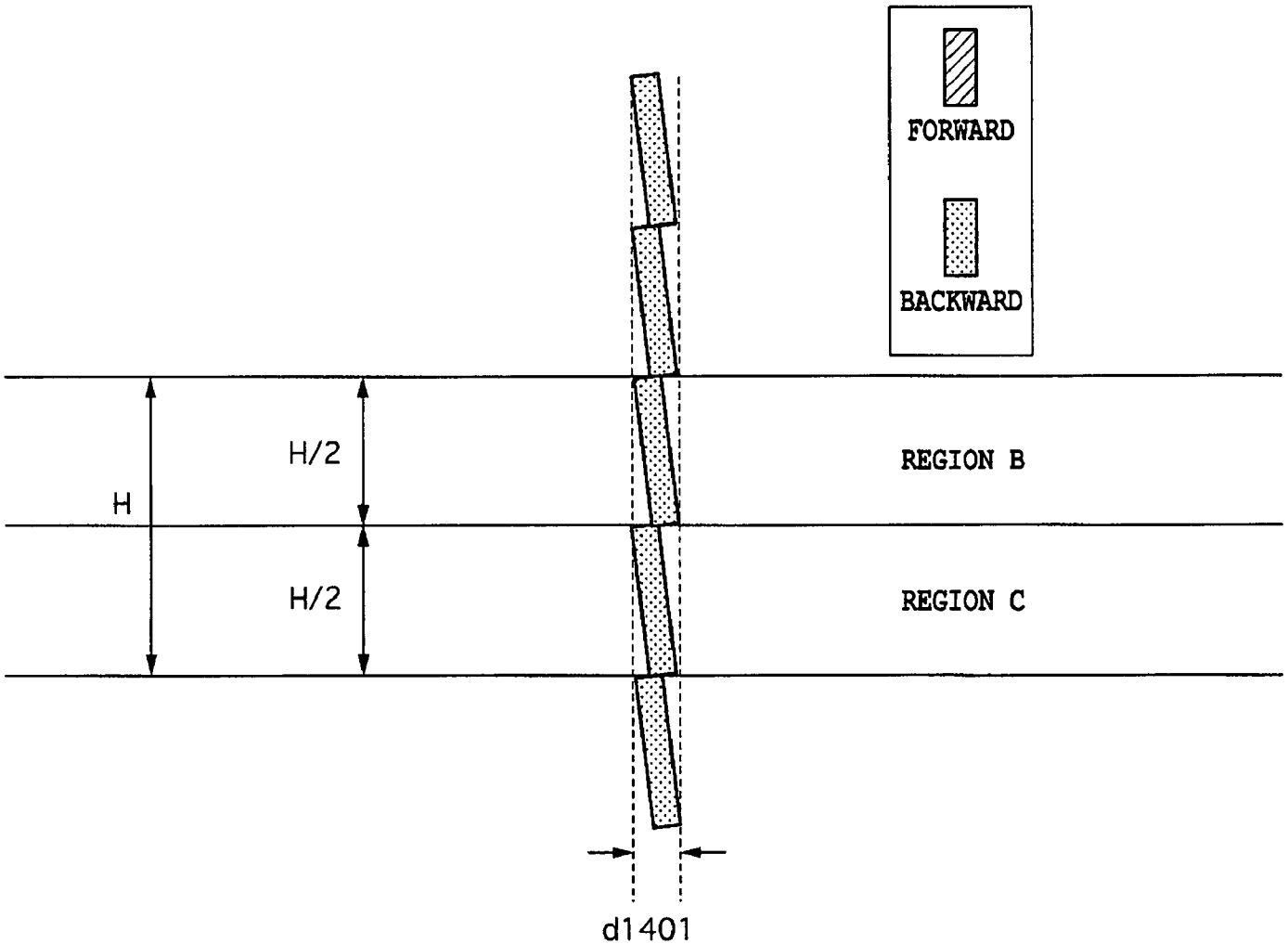
FIG. 11 is a view showing ruled lines formed by the bidirectional printing with two passes while an inclination is corrected by use of the printing head having an inclination when no displacement in the bidirectional printing exists.
Figure 12:
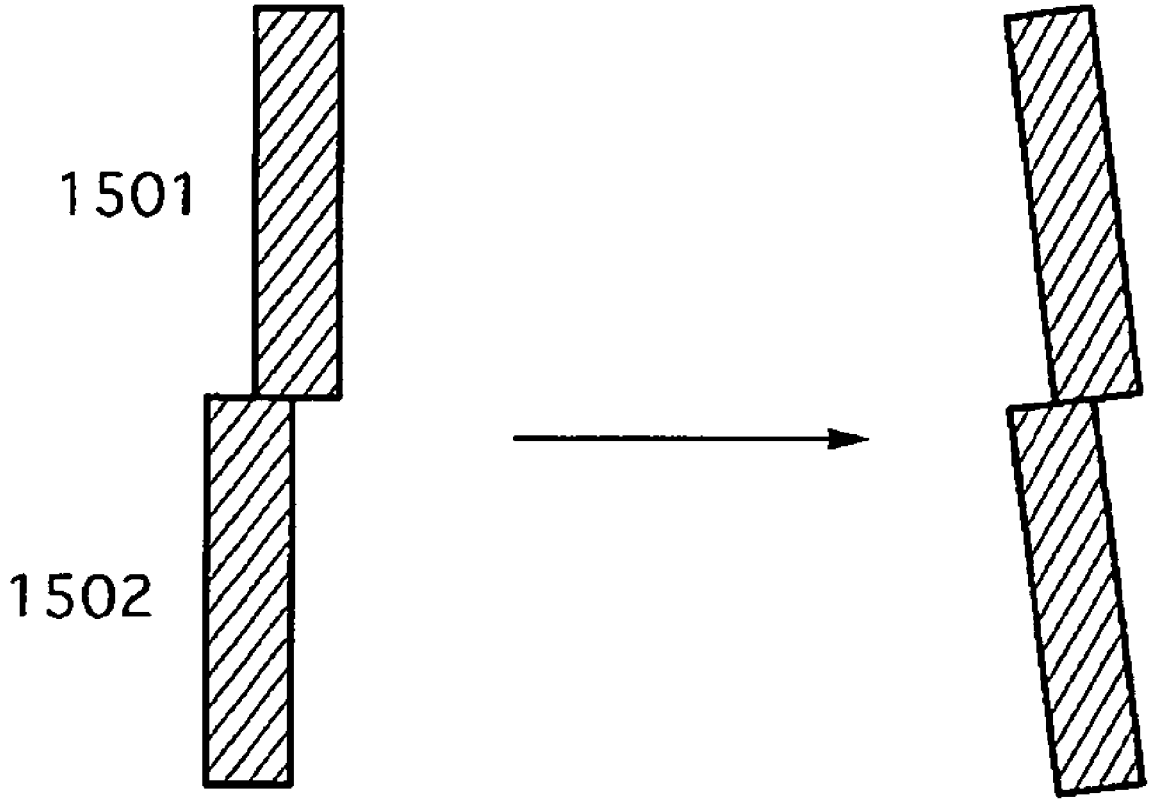
FIG. 12 is a view showing block division for correcting the inclination of the printing head.
Figure 13:
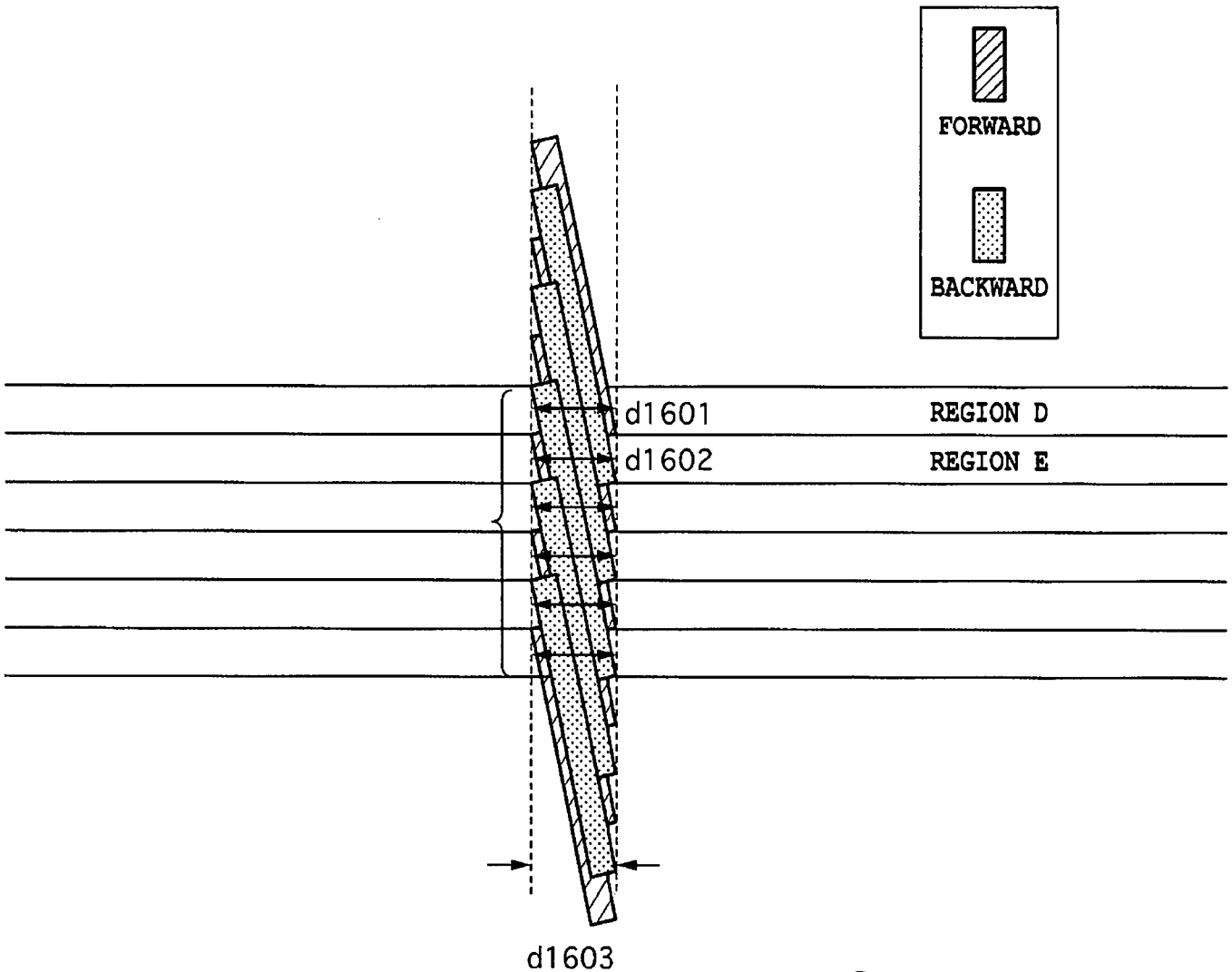
FIG. 13 is a view showing ruled lines formed by bidirectional printing with six passes by use of the printing head having an inclination when no displacement in the bidirectional printing exists.
Figure 14:
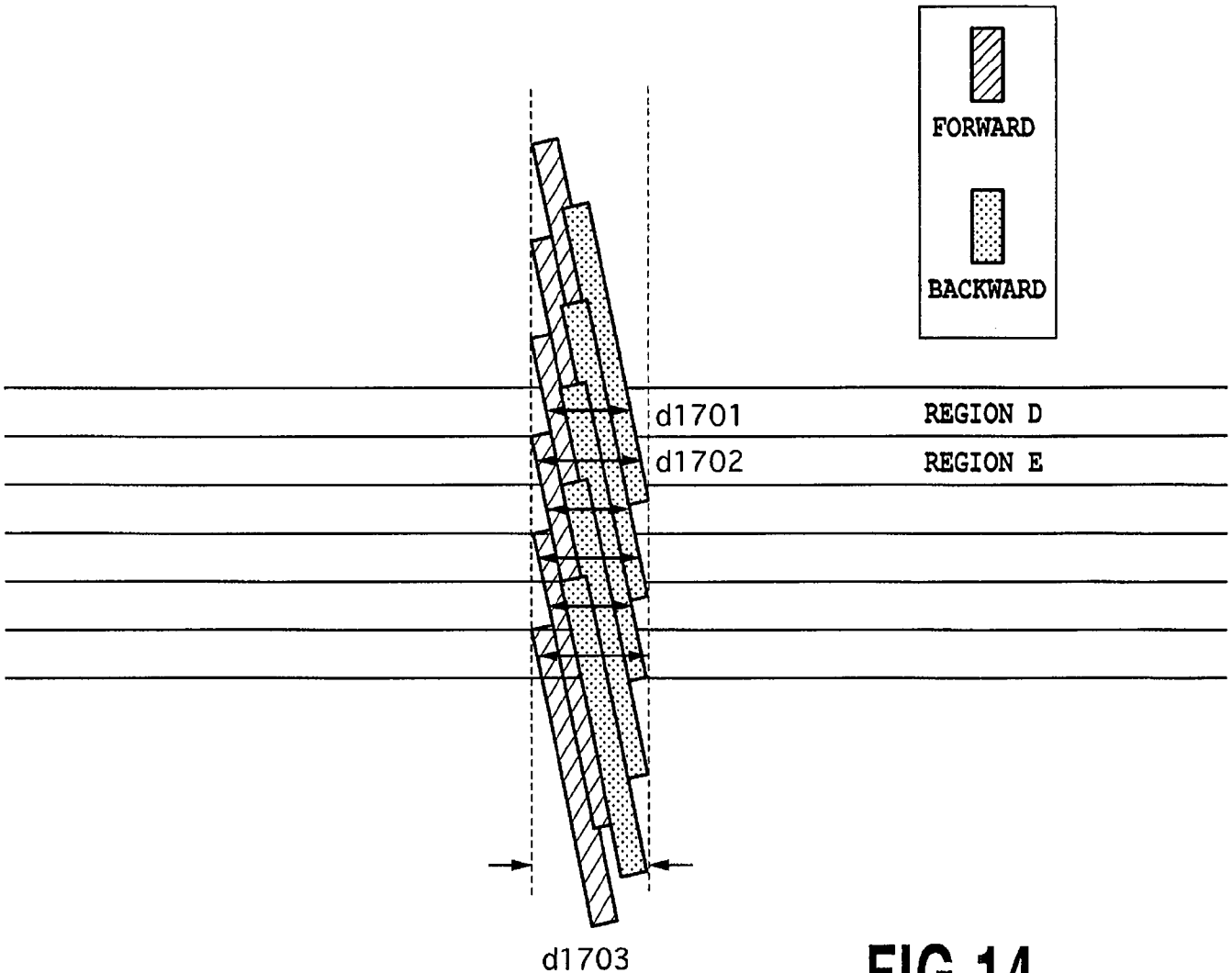
FIG. 14 is a view showing ruled lines formed by the bidirectional printing with six passes by use of the printing head having an inclination when a displacement in the bidirectional printing exists.
Figure 15A:
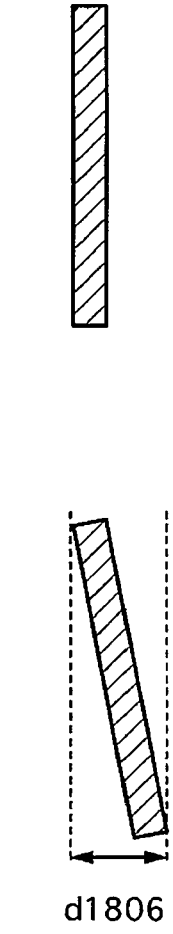
FIGS. 15A to 15C are views showing a plurality of block division methods for correcting the inclination of the printing head and showing inclination correction states in the respective division methods.
Figure 15B:
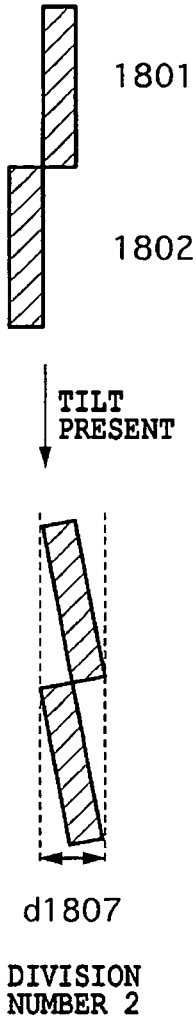
Figure 15C:
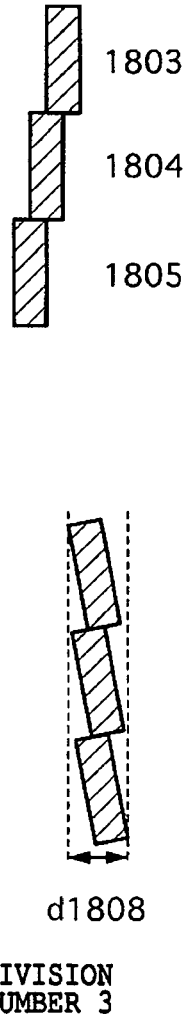
Figure 16:
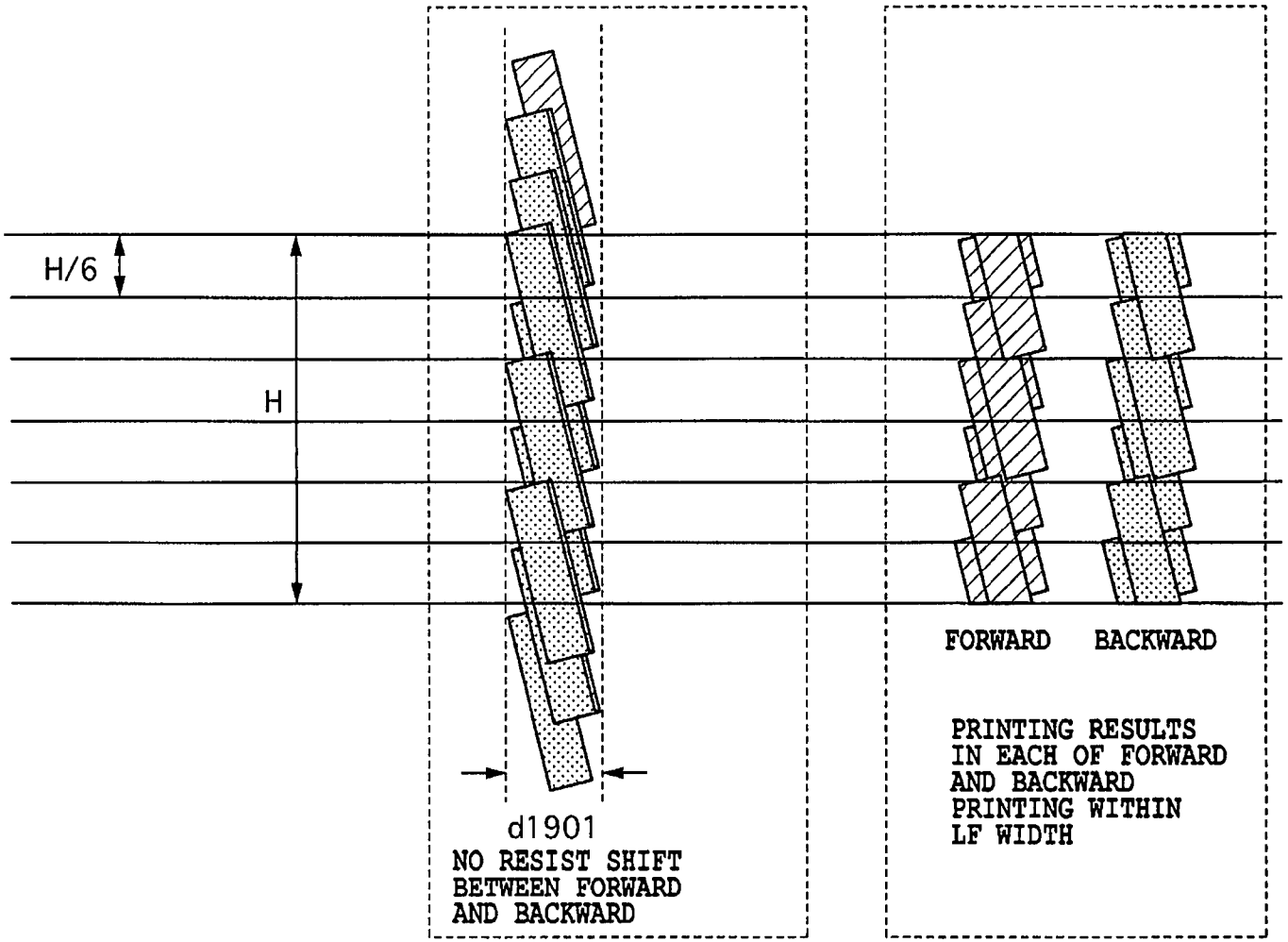
FIG. 16 is a view showing ruled lines formed by the bidirectional printing with six passes while 2-division inclination correction is performed by use of the printing head having an inclination when no displacement in the bidirectional printing exists.
Figure 17:
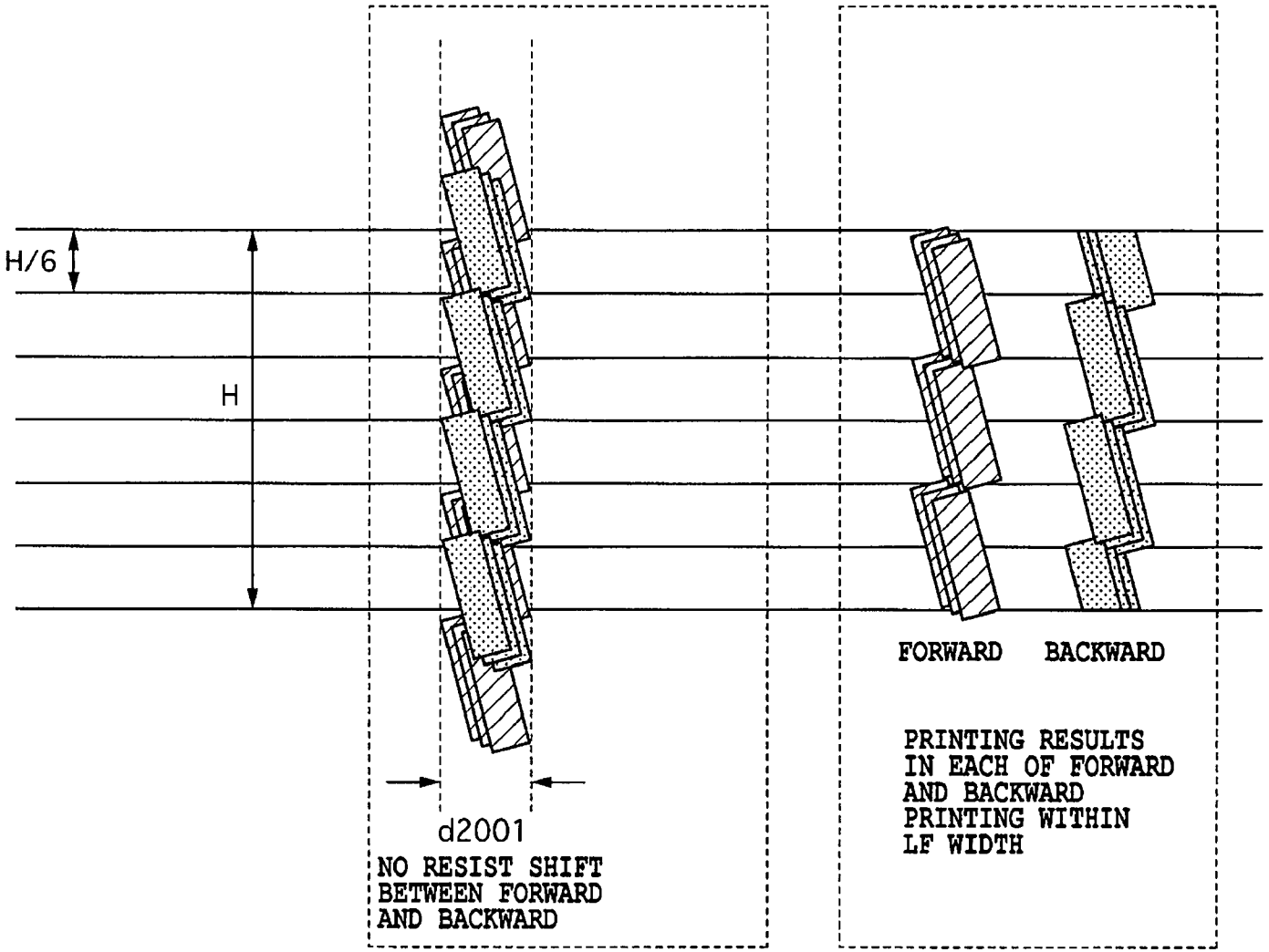
FIG. 17 is a view showing ruled lines formed by the bidirectional printing with six passes while 3-division inclination correction is performed by use of the printing head having an inclination when no displacement in the bidirectional printing exists.
Figure 27:
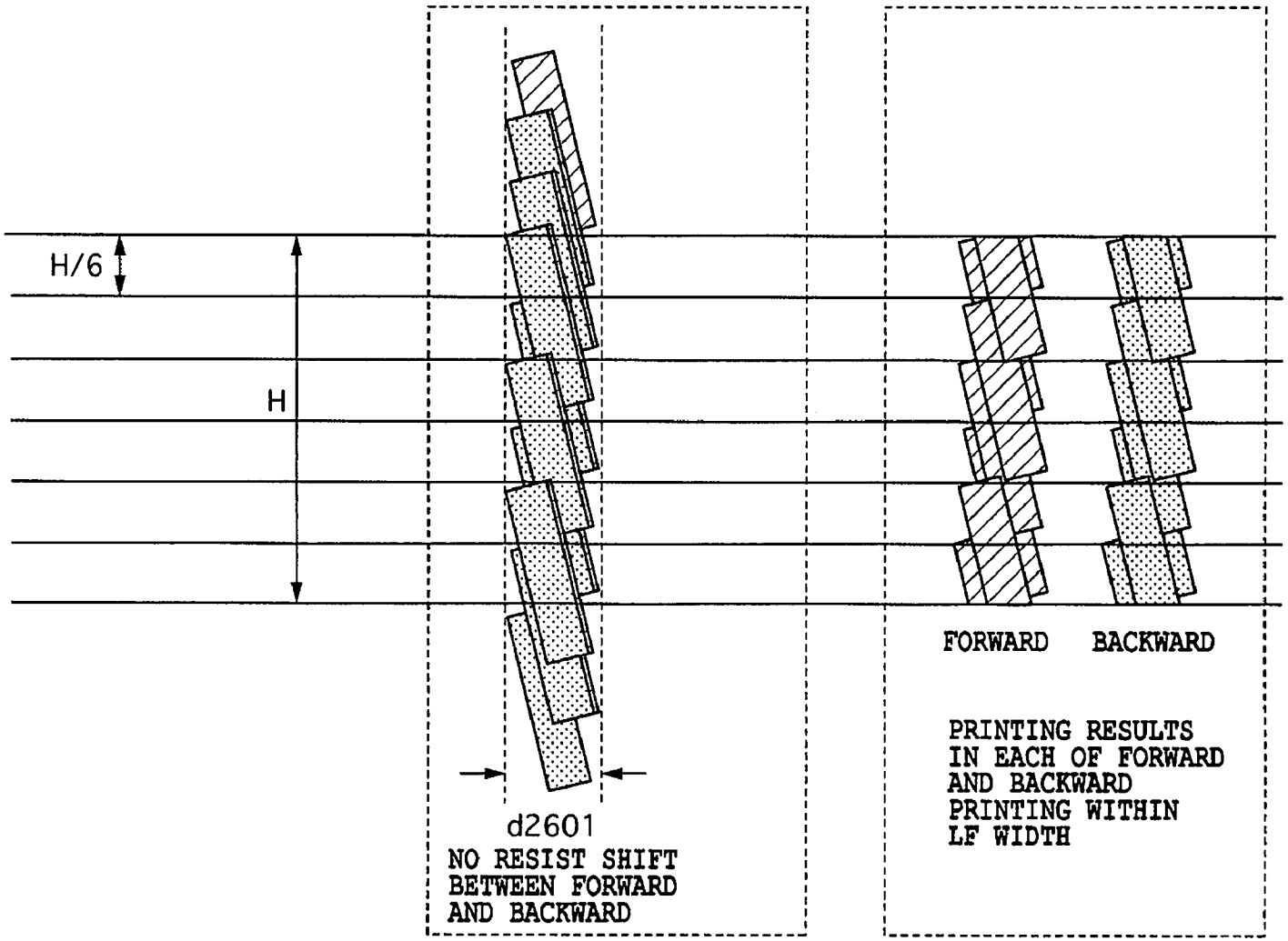
FIG. 27 is a view showing a state where a ruled line pattern is formed by bidirectional printing with six passes.
Figure 28:
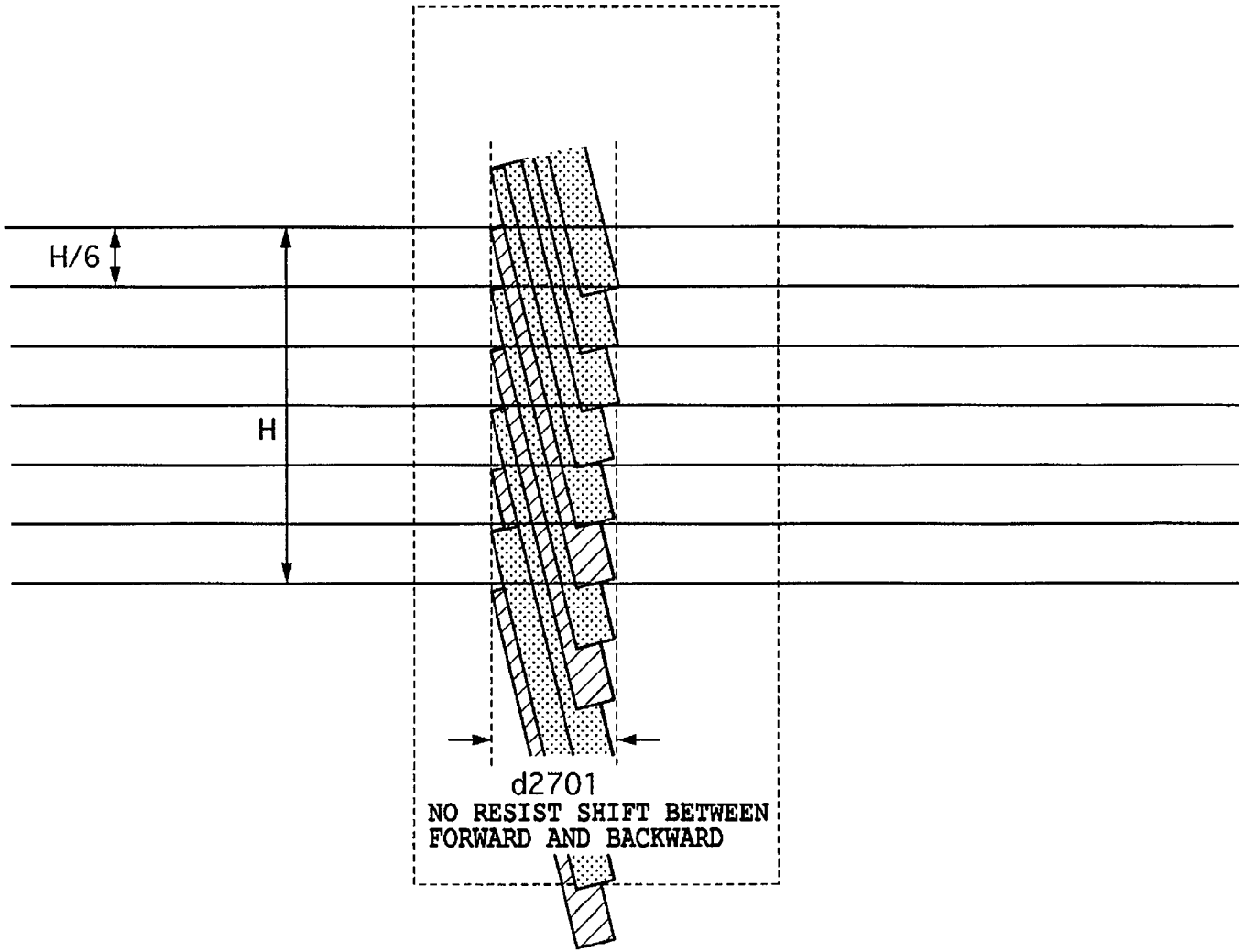
FIG. 28 is a view showing a state where a ruled line pattern is formed by the bidirectional printing with six passes without performing inclination correction.

FIG. 27 shows a state where a ruled line pattern similar to that shown in FIG. 3 is formed by bidirectional printing with six passes in the state shown in FIG. 26. Moreover, FIG. 28 shows a state where a ruled line pattern similar to that shown in FIG. 3 is formed by the bidirectional printing with six passes without performing inclination correction. Note that both of FIGS. 27 and 28 show a state where there is no displacement in a bidirectional printing. In FIG. 27, since 2-division inclination correction is performed, an inclination width d2601 after correction is smaller than an inclination width d2701 before correction. Thus, "graininess" is also suppressed compared with that in FIG. 28.

Figure 29:
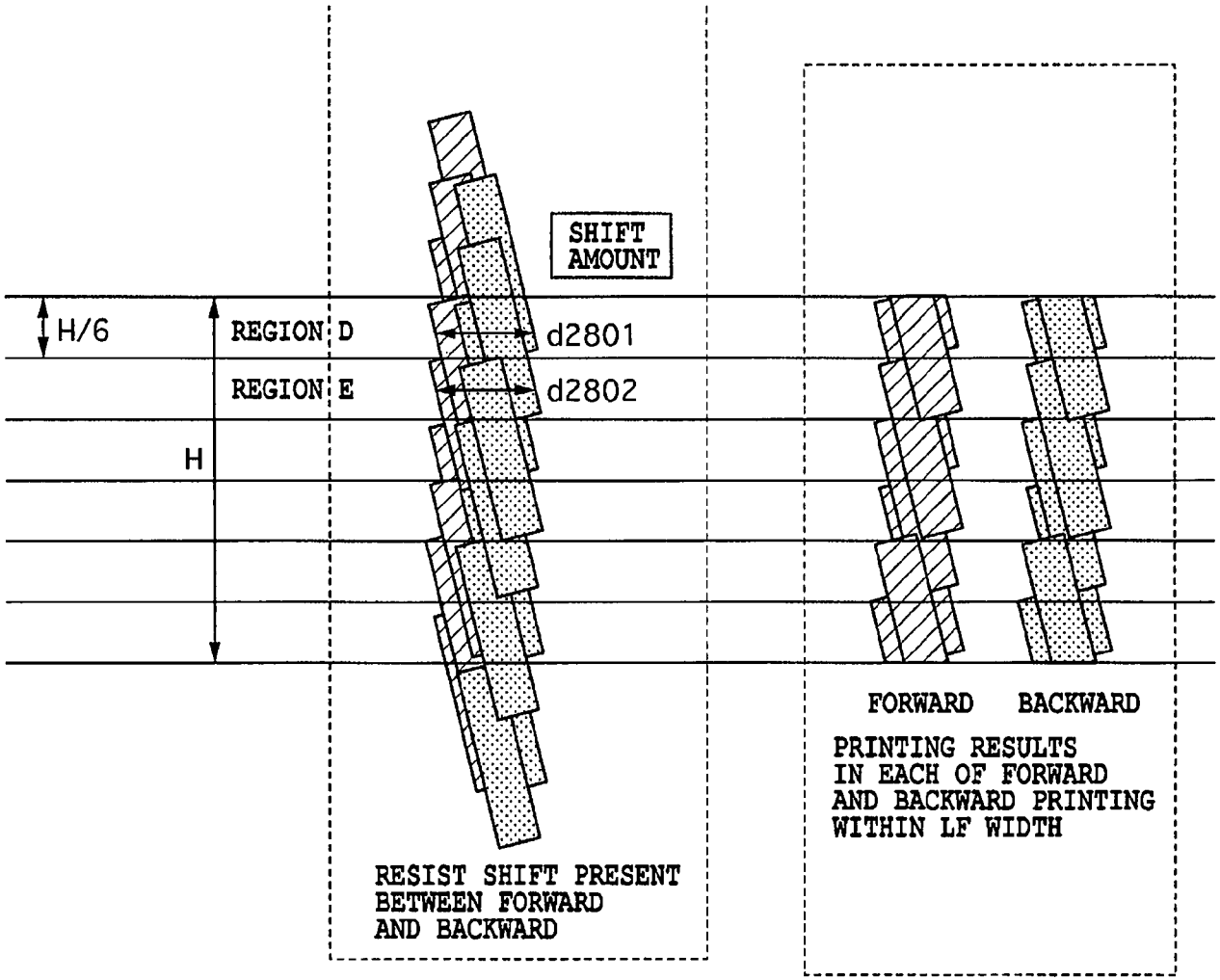
FIG. 29 is a view showing a state where a ruled line pattern is formed by the bidirectional printing with six passes.

FIG. 29 shows a state where a ruled line pattern similar to that shown in FIG. 3 is formed by the bidirectional printing with six passes in the state shown in FIG. 26. Note that, here, FIG. 29 shows a state where there is a displacement in the bidirectional printing. As is clear from FIG. 29, a region formed by the forward scanning and a region formed by the backward scanning are disposed in the state of being displaced from each other in the main scanning direction. However, so as to set a displacement width d2801 in a region D to be equal to a displacement width d2802 in a region E, a displacement width is not changed among a plurality of regions arranged in the sub-scanning direction. Thus, the "band unevenness" does not occur.

Next, as a second example, description will be given for a case where bidirectional printing with 6 passes is performed by use of a printing head in which 384 printing elements are arranged at a pitch of 1200 dpi. In this event, an inclination amount of the printing head is set to 2 pixels. Specifically, positions of dots, which are printed by two printing elements positioned on both ends of the printing element array, are displaced by 2 pixels (42 μm) in the main scanning direction. Under the conditions described above, inclination correction is realized by 2-division printing in which the second block is shifted by 1 pixel. In this example, a resolution is doubled compared with that in the first example, but the number of multi-passes and the inclination pixel amount are set the same. Thus, the proper number of block divisions and the data shift amount of each block, which are obtained in Step S205, are also set the same as those in the first example. Specifically, also in the case of this example, it suffices that the 2-division printing, in which the second block is shifted by 1 pixel, be performed.

Figure 30:
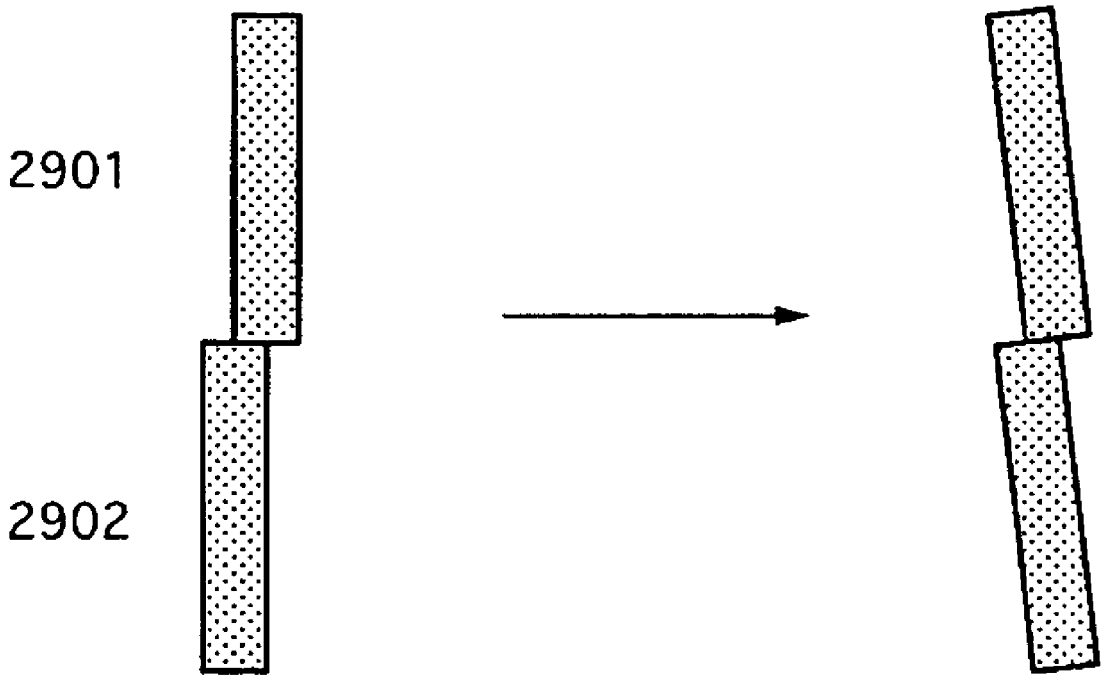
FIG. 30 is a schematic view for explaining an inclination correction state of the printing head.

FIG. 30 is a schematic view for explaining an inclination correction state of the printing head of this example. The printing head is driven in a manner in which data in a second block 2902 is shifted by 1 pixel from a first block 2901 (shown on the left side of FIG. 30). In a state where the printing head is inclined, an image is printed in a state shown on the right side of FIG. 30.

Figure 31:
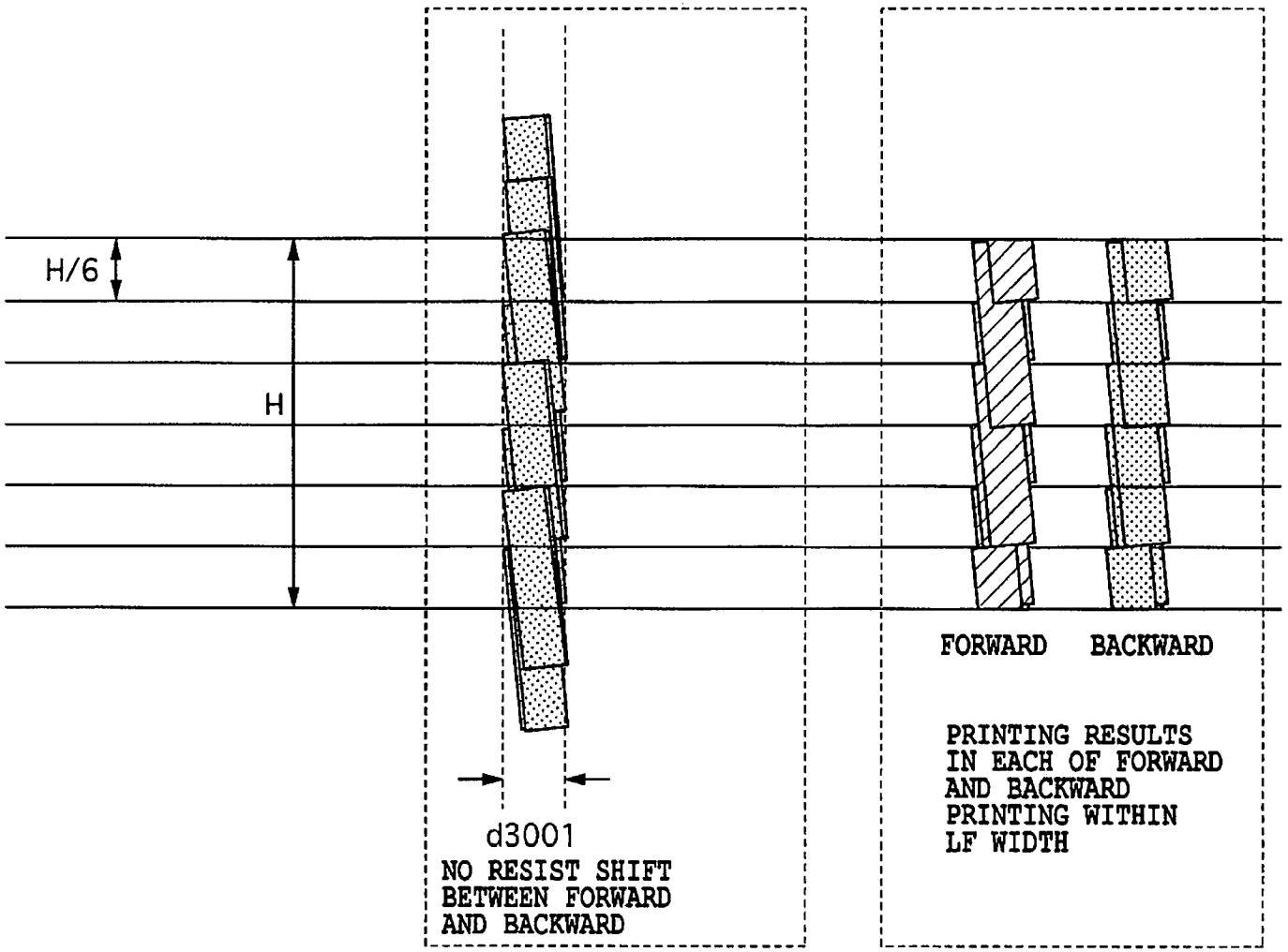
FIG. 31 is a view showing a state where a ruled line pattern is formed by the bidirectional printing with six passes.
Figure 32:
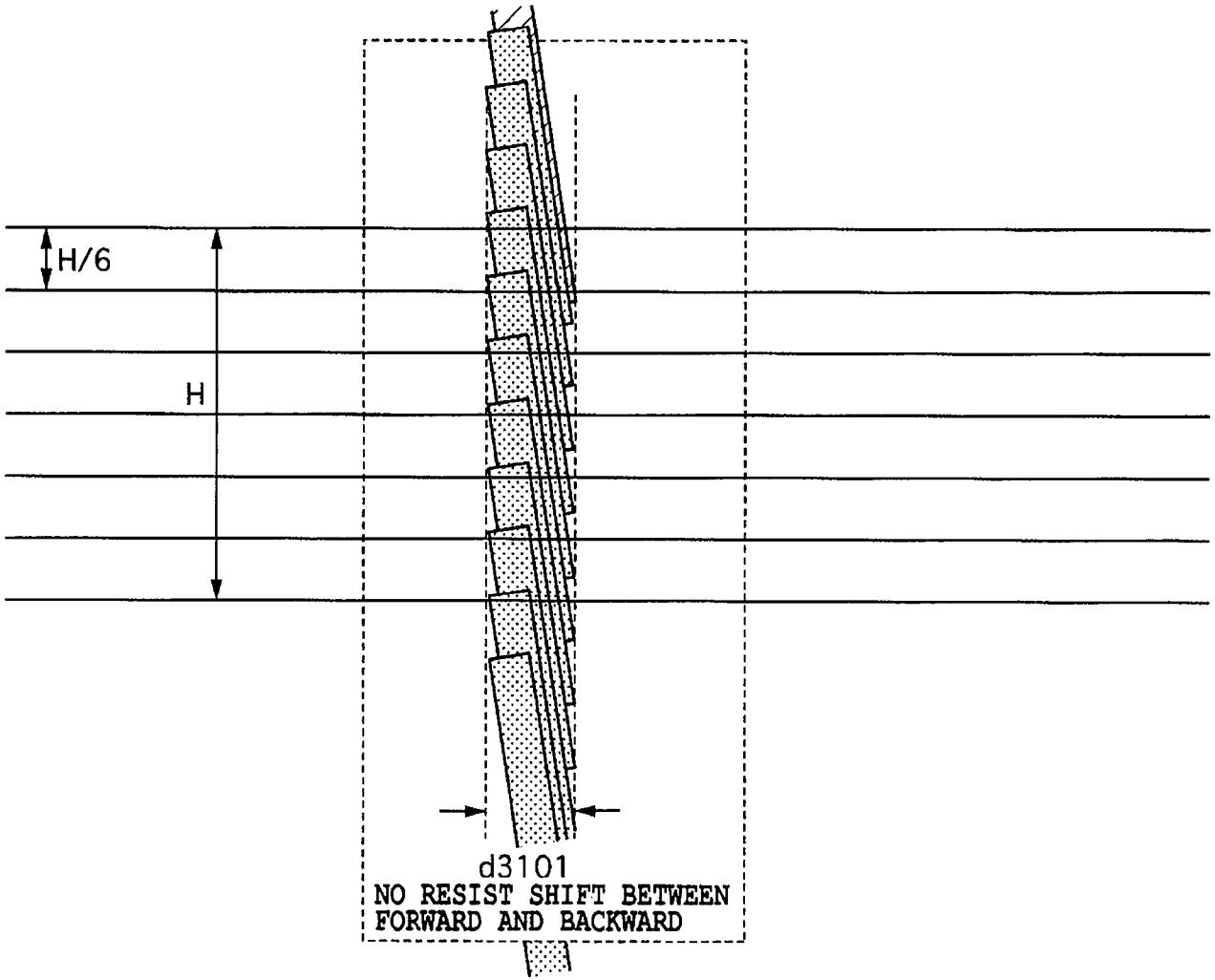
FIG. 32 is a view showing a state where a ruled line pattern is formed by the bidirectional printing with six passes without performing inclination correction.

FIG. 31 shows a state where a ruled line pattern similar to that shown in FIG. 3 is formed by the bidirectional printing with six passes in the state shown in FIG. 30. Moreover, FIG. 32 shows a state where a ruled line pattern similar to that shown in FIG. 3 is formed by the bidirectional printing with six passes without performing inclination correction. Note that both of FIGS. 31 and 32 show a state where there is no displacement in a bidirectional printing. In FIG. 31, since 2-division inclination correction is performed, an inclination width d3001 after correction is smaller than an inclination width d3101 before correction. Thus, "graininess" is also suppressed compared with that in FIG. 32.

Figure 33:
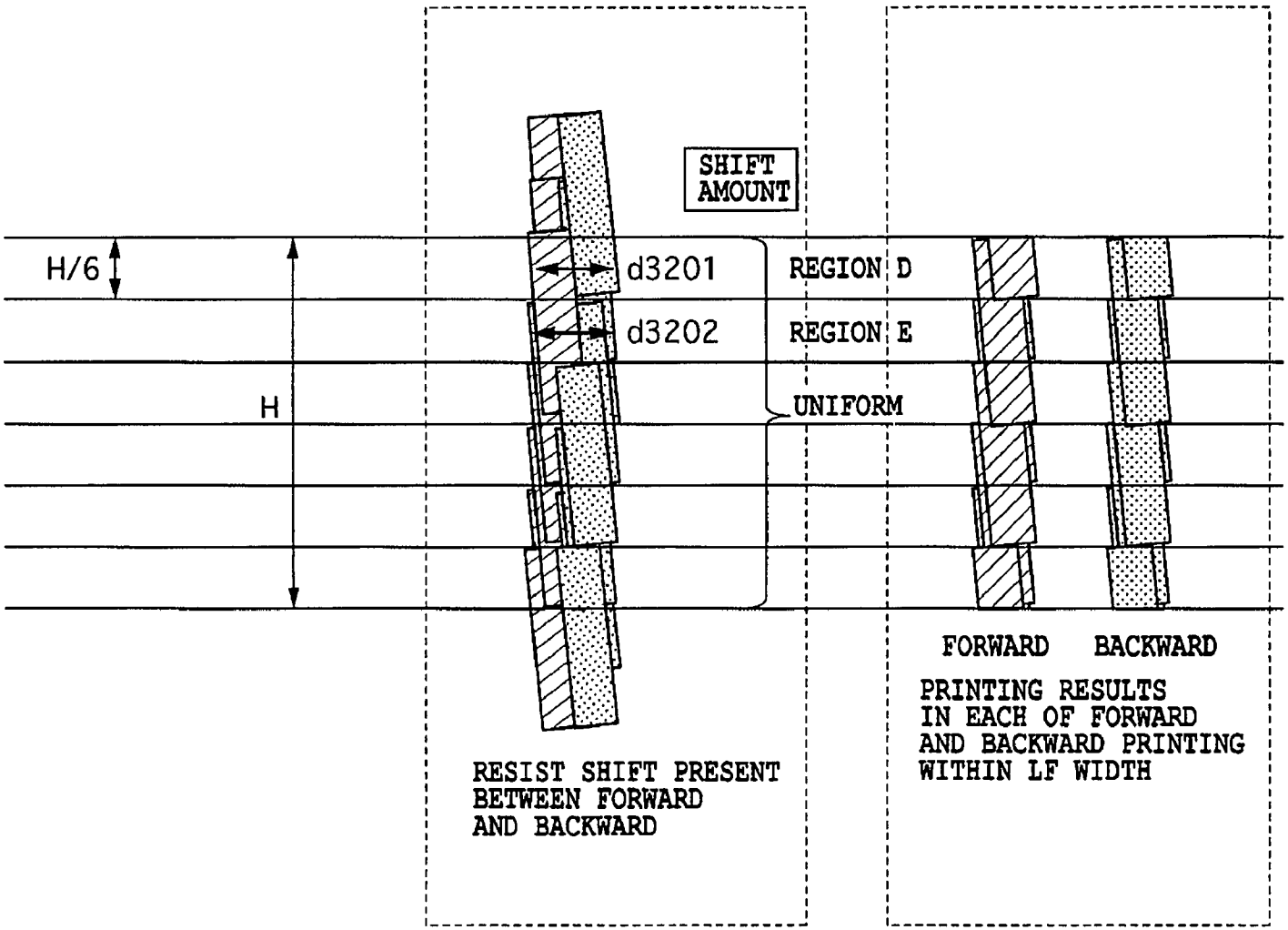
FIG. 33 is a view showing a state where a ruled line pattern is formed by the bidirectional printing with six passes.

FIG. 33 shows a state where a ruled line pattern similar to that shown in FIG. 3 is formed by the bidirectional printing with six passes in the state shown in FIG. 30. Note that, here, FIG. 33 shows a state where there is a displacement in the bidirectional printing. As is clear from FIG. 33, a region formed by the forward scanning and a region formed by the backward scanning are disposed in the state of being displaced from each other in the main scanning direction. However, so as to set a displacement width d3201 in a region D to be equal to a displacement width d3202 in a region E, a displacement width is not changed among a plurality of regions arranged in the sub-scanning direction. Thus, the "band unevenness" does not occur.

Specifically, according to the inclination correction method of this embodiment, even by use of the printing heads which are different from each other in the resolution and the number of printing elements as in the first and second examples, parameters (in other words, the number of divided blocks and the data shift amount) for inclination correction are set the same as long as the number of multi-passes and the number of inclined pixels in printing are the same. Thus, in both of the examples, bidirectional multi-pass printing, in which no "band unevenness" occurs, can be realized.

Next, as a third example, description will be given for a case where bidirectional printing with 2 passes is performed by use of a printing head in which printing elements are arranged at a pitch of 2400 dpi. In this event, an inclination amount of the printing head is set to 8 pixels. Specifically, positions of dots, which are printed by two printing elements positioned on both ends of the printing element array, are displaced by 8 pixels (168 μm) in the main scanning direction. Under the conditions described above, it suffices that the number of block divisions so as not to cause the "band unevenness" be even division such as 2-division, 4-division, 6-division, 8-division . . . , according to FIG. 23. Here, if 2-division, for example, is adopted, the second block is shifted by 4 pixels in inclination correction. If 4-division is adopted, the second block is shifted by 2 pixels, the third block is shifted by 4 pixels, and the fourth block is shifted by 6 pixels. Furthermore, if 8-division is adopted, the second block is shifted by 1 pixel, the third block is shifted by 2 pixels, the fourth block is shifted by 3 pixels, the fifth block is shifted by 4 pixels, the sixth block is shifted by 5 pixels, the seventh block is shifted by 6 pixels, and the eighth block is shifted by 7 pixels.

The plurality of candidates as described above is cited as a block division method so as not to cause the "band unevenness". However, image quality obtained by actually performing inclination correction is not the same among the candidates. With reference to the drawings, description will be given for a case where inclination correction is performed by 2-division printing and a case where inclination correction is performed by 4-division printing.

Figure 34:
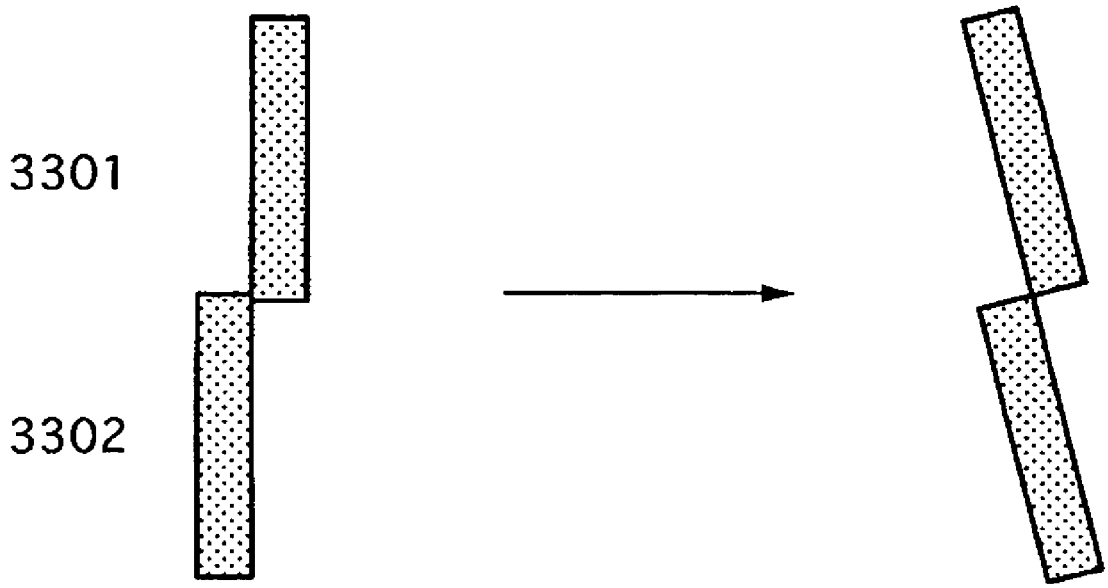
FIG. 34 is a schematic view for explaining an inclination correction state in 2-division printing.

FIG. 34 is a schematic view for explaining an inclination correction state in 2-division printing. The printing head is driven in a manner in which data in a second block 3302 is shifted for 4 pixels from a first block 3301 (shown on the left side of FIG. 34). In a state where the printing head is inclined, an image is formed in a state shown on the right side of FIG. 34.

Figure 35:
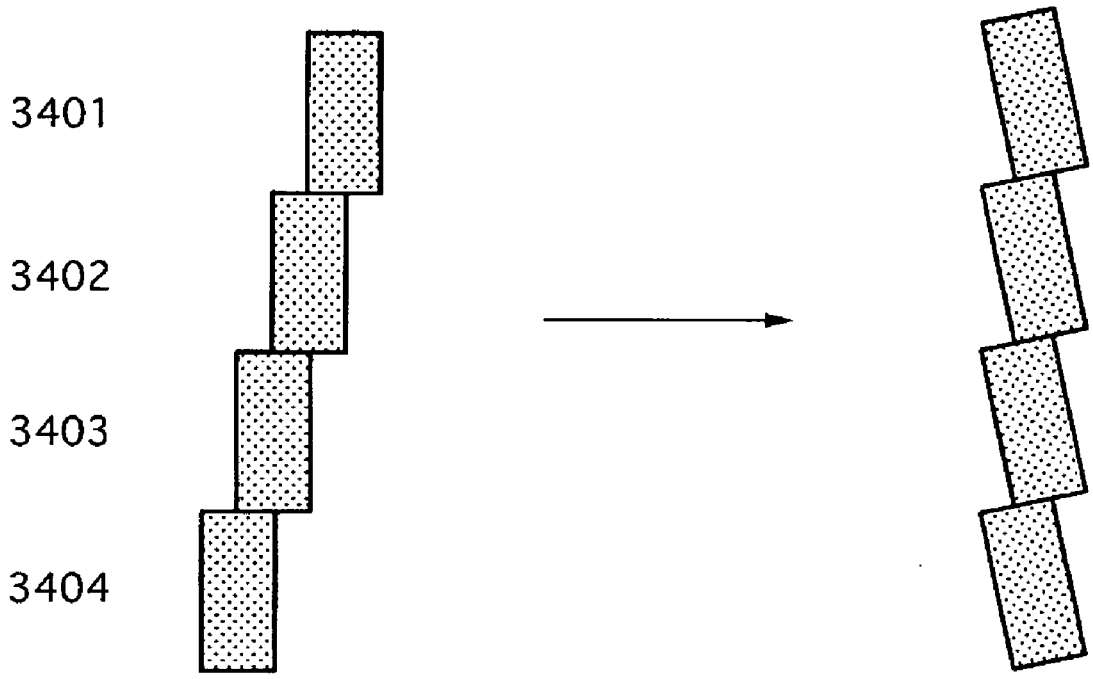
FIG. 35 is a schematic view for explaining an inclination correction state in 4-division printing.

FIG. 35 is a schematic view for explaining an inclination correction state in 4-division printing. The printing head is driven in a manner in which data in a second block 3402 is shifted for 2 pixels, data in a third block 3403 is shifted for 4 pixels and data in a fourth block 3404 is shifted for 6 pixels, respectively, from a first block 3401 (shown on the left side of FIG. 35). In a state where the printing head is inclined, an image is formed in a state shown on the right side of FIG. 35.

Figure 36:
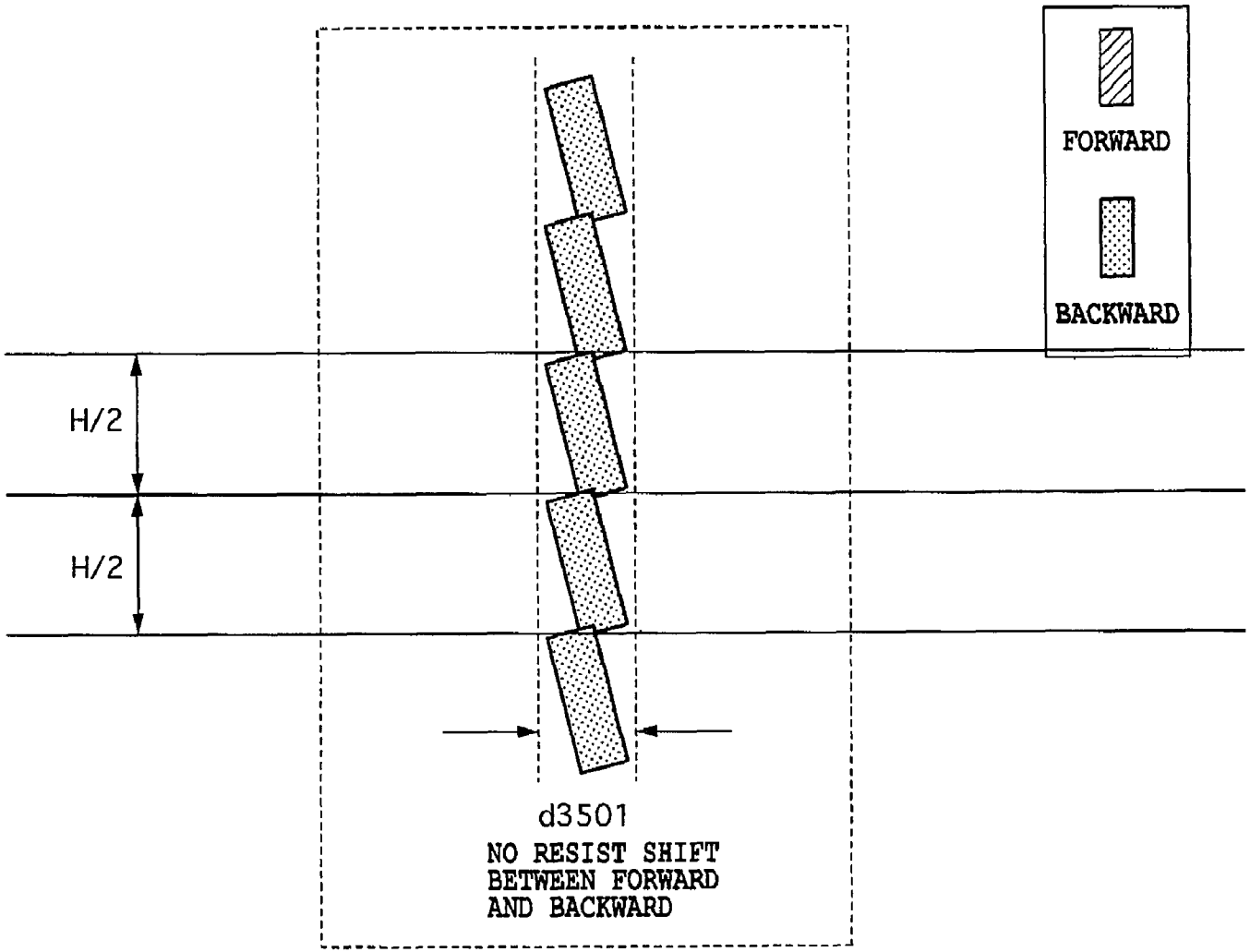
FIG. 36 is a view showing a state where a ruled line pattern is formed by 2-division bidirectional printing with two passes.
Figure 37:
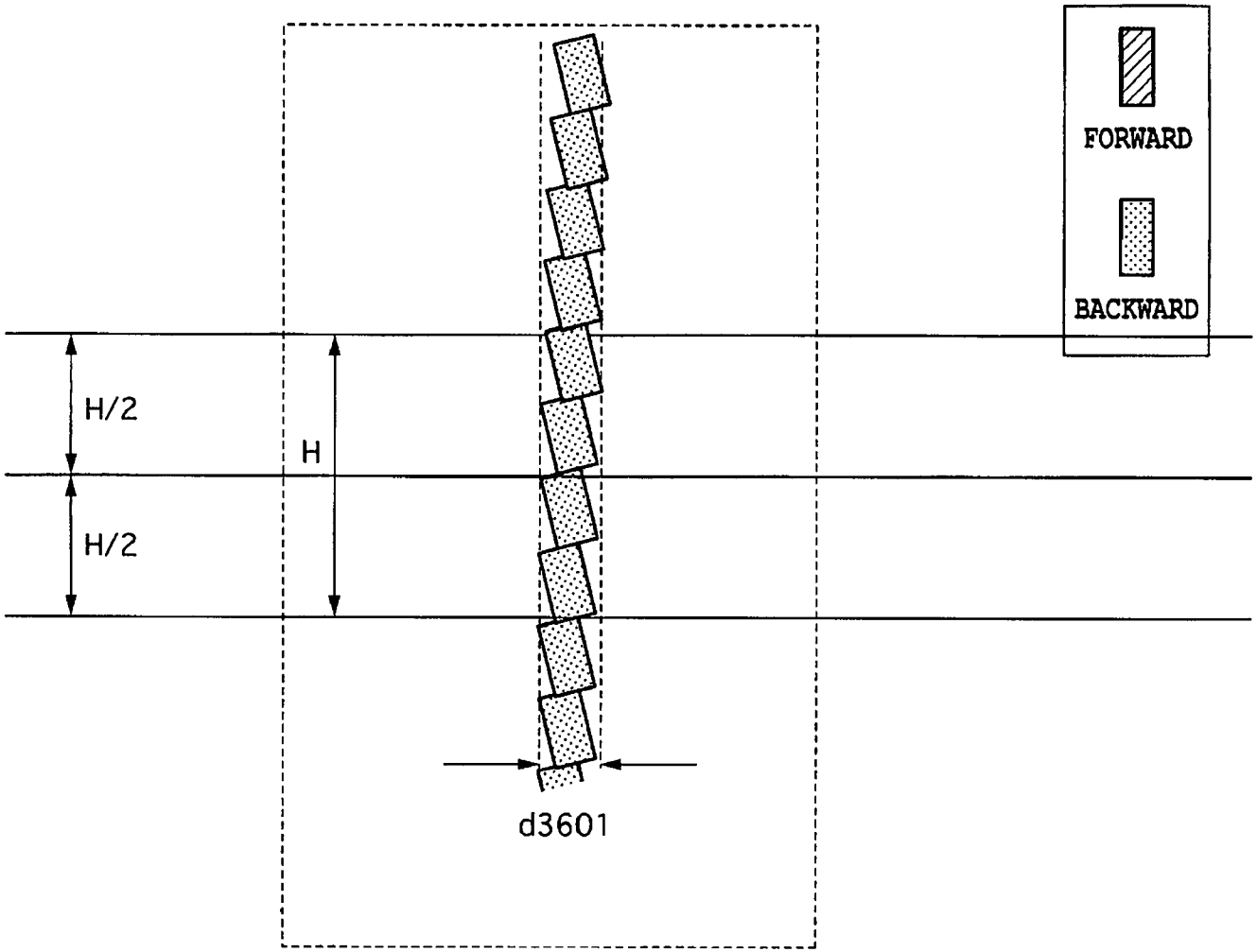
FIG. 37 is a view showing a state where a ruled line pattern is formed by 4-division bidirectional printing with two passes.
Figure 38:
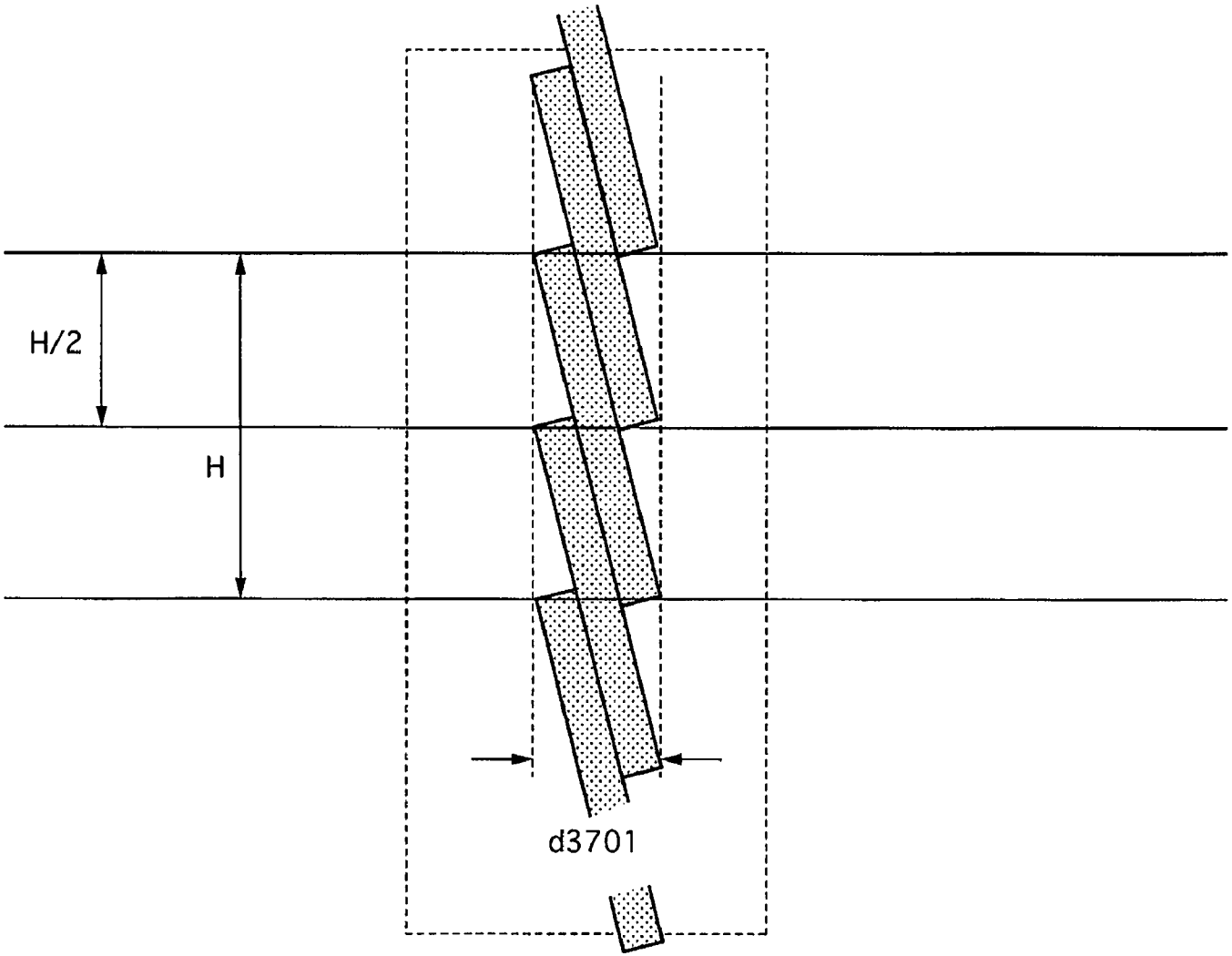
FIG. 38 is a view showing a state where a ruled line pattern is formed by bidirectional printing with two passes without performing inclination correction.

FIG. 36 shows a state where a ruled line pattern similar to that shown in FIG. 3 is formed by 2-division bidirectional printing with two passes, as shown in FIG. 34. Moreover, FIG. 37 shows a state where a ruled line pattern similar to that shown in FIG. 3 is formed by 4-division bidirectional printing with two passes, as shown in FIG. 35. Furthermore, FIG. 38 shows a state where a ruled line pattern similar to that shown in FIG. 3 is formed by bidirectional printing with two passes without performing inclination correction. Note that all of FIGS. 36 to 38 show the state where there is no displacement in bidirectional printing.

In FIG. 36, since 2-division inclination correction is performed, an inclination width d3501 after correction is smaller than an inclination width d3701 before correction. In FIG. 37, since 4-division inclination correction is performed, an inclination width d3601 after correction is further smaller than the inclination width d3501 after 2-division correction. Specifically, from the viewpoint of "graininess" a better image can be obtained when 4-division printing is performed.

Next, "band unevenness" will be considered.

Figure 39:
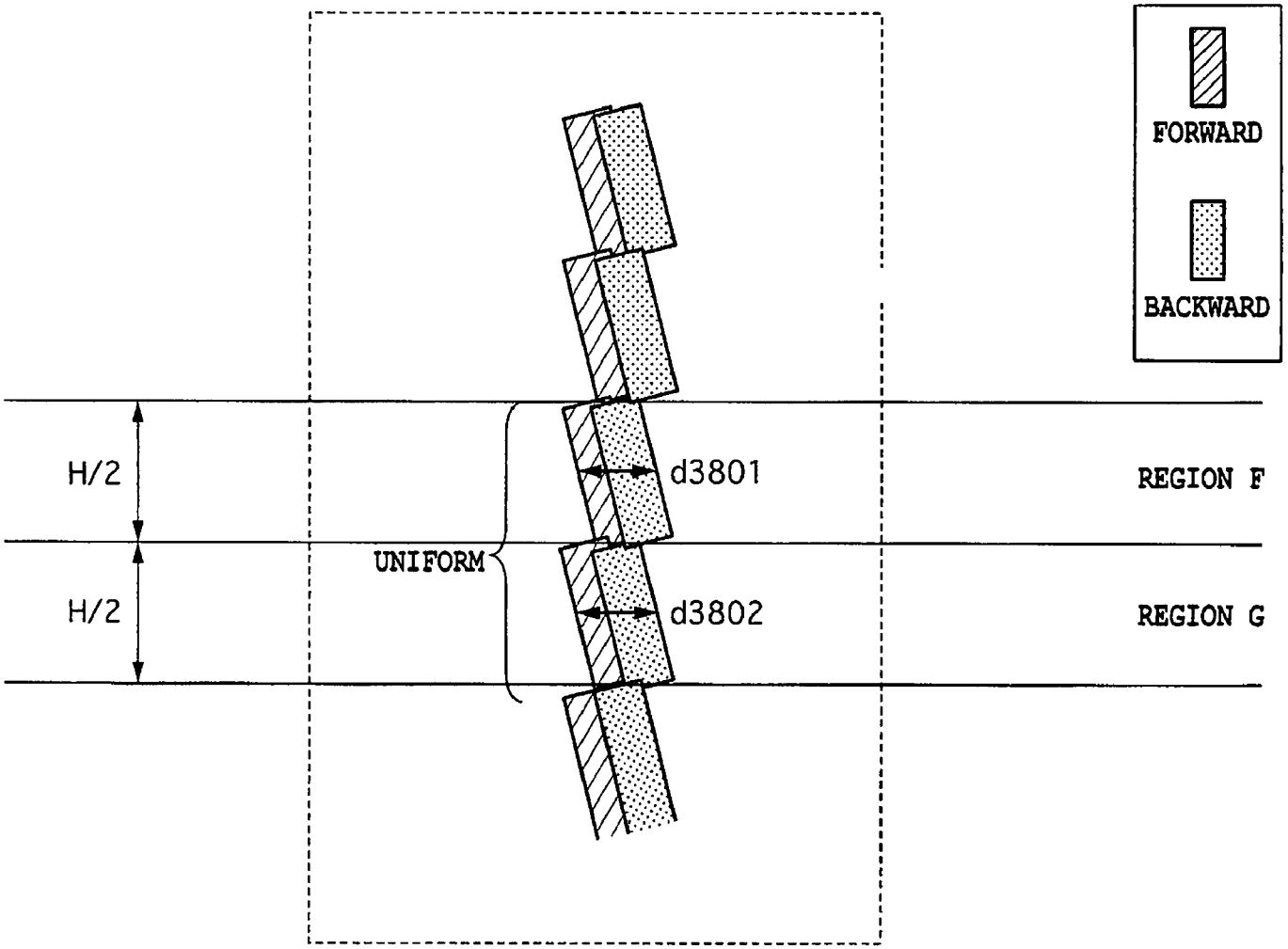
FIG. 39 is a view showing a printing state when a displacement in a bidirectional printing exists.
Figure 40:
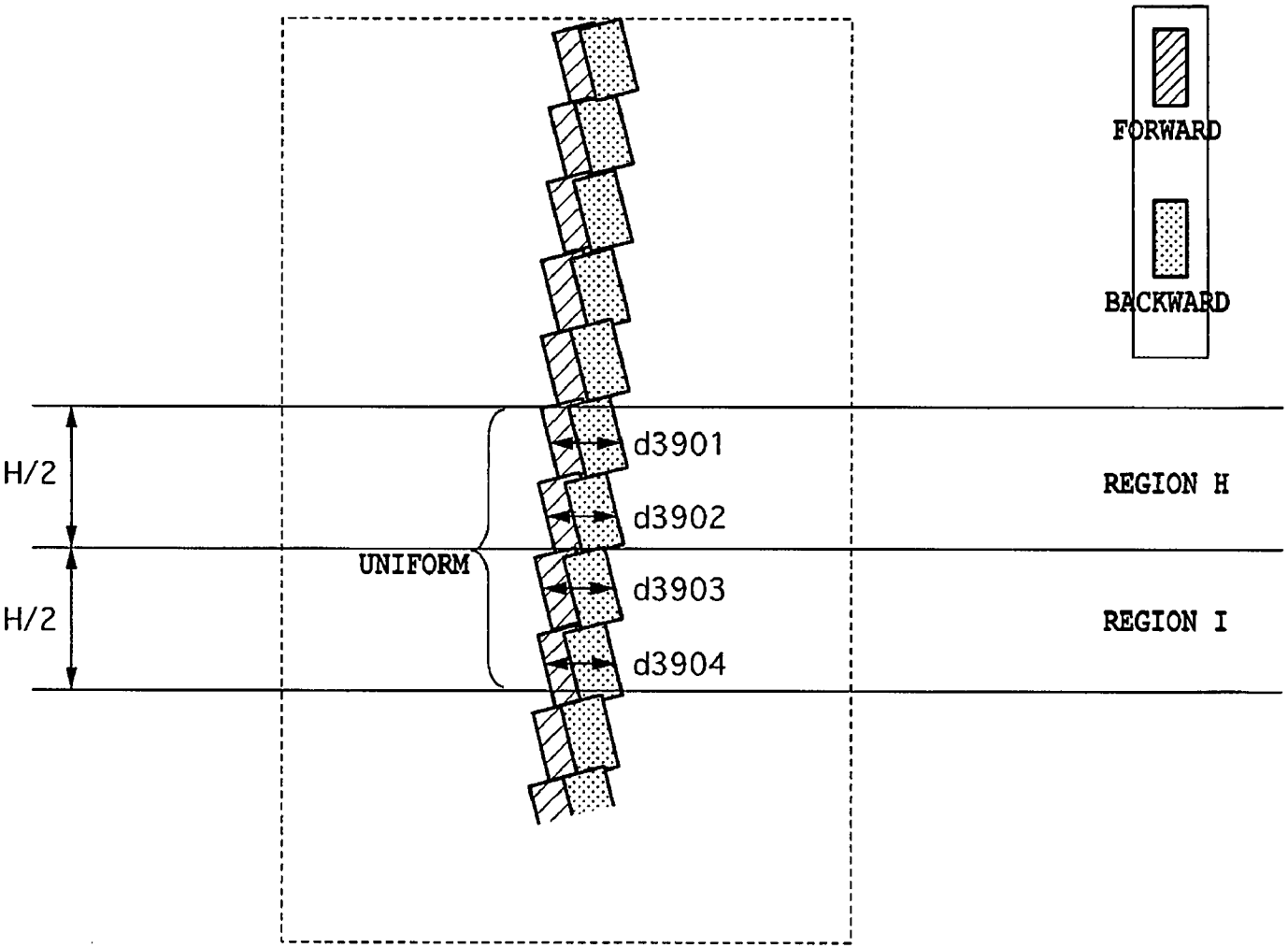
FIG. 40 is a view showing a printing state when a displacement in the bidirectional printing exists.

Each of FIGS. 39 and 40 shows a printing state when a displacement in the bidirectional printing exists respectively in states shown in FIGS. 36 and 37. As is clear from FIGS. 39 and 40, a region formed by the forward scanning and a region formed by the backward scanning are disposed in the state of being displaced from each other in the main scanning direction.

In both of FIGS. 39 and 40, a printing width d3801 in a region F and a printing width d3802 in a region G at the time when 2-division printing is performed, and printing widths d3901 and d3902 in a region H and printing widths d3903 and d3904 in a region I at the time when 4-division printing is performed, are all the same. In terms of the "band unevenness", both of 2-division printing and 4-division printing are equally good and there is no difference therebetween.

From the above results, it can be understood that, even among the division methods which equally prevent the "band unevenness", a difference may arise in "ruled line displacement" or "graininess". The cases of 2-division and 4-division have been described above. Among division conditions for preventing the "band unevenness", however, the larger the number of divisions is the more reduction in the "graininess" is expected. For example, in the third example, since an inclination for 8 pixels is included, 8-division correction, in which data can be shifted by 1 pixel in each block, enables the finest and most proper correction.

However, it is difficult to provide an ordinary ink jet printing apparatus with the division number for driving blocks without any restriction. A restriction of about 4 blocks, 8 blocks or 16 blocks is often applied. Thus, in this embodiment, a two-dimensional table, in which the number of divided blocks and the data shift amount in each block are uniquely set, is prepared in the following manner. Specifically, the table is prepared so as to suppress the "graininess" as much as possible, and to efficiently set the data shift, in which 1 pixel is set as the minimum unit, for each block. The table is prepared with the division numbers among the ones which prevent the "band unevenness" under the restriction as described above.

As described above, according to this embodiment, the printing apparatus includes means for acquiring the proper number of block divisions and the data shift amount of each block based on the number of multi-passes and the inclination amount of the printing head. Thus, when bidirectional multi-pass printing is carried out by use of the printing head having an inclination, occurrence of the "band unevenness", which has heretofore been a problem, can be avoided as much as possible even if a displacement in the bidirectional printing exists.

Note that the above description has been given for the ink jet printing apparatus which forms an image by discharging ink as a printing agent, as an example. However, effects of the present invention are not limited to the configuration as described above. The effects of the present invention can be achieved as long as the printing apparatus is a serial printing apparatus capable of forming an image by applying a printing agent onto a printing medium from a printing head in which a plurality of printing elements are arranged.

By adopting the configuration described above, according to the present invention, even if the bidirectional printing is somewhat displaced, the printing widths are equally increased or reduced in the respective regions. Thus, it is made possible to avoid the "band unevenness" which is caused by differences in the printing width among the regions.

The present invention has been described in detail with respect to preferred embodiments, and it will now be apparent from the foregoing to those skilled in the art that changes and modifications may be made without departing from the invention in its broader aspects, and it is the intention, therefore that the appended claims cover all such changes and modifications as fall within the true spirit of the invention.

This application claims priority from Japanese Patent Application No. 2005-200158 filed Jul. 8, 2005, which is hereby incorporated by reference herein.

What is claimed is:

1. A printing apparatus which forms an image on a printing medium by alternately repeating print main scanning, in which a printing element array including a plurality of printing elements arranged in a predetermined direction is moved in a direction intersecting the predetermined direction, and sub-scanning, in which the printing medium is transported in a direction intersecting the print main scanning by an amount smaller than a width of the printing element array, the printing elements applying a printing agent onto the printing medium according to image data, so that printing on a same image region of the printing medium is completed by repeating the print main scanning and the sub-scanning plural times, said apparatus comprising:

means for acquiring inclination information on the printing element array;

means for acquiring a printing mode for the image data to be printed, the printing mode including information of a number of the plural times;

means for setting a division number B (an integer of not less than 1) for dividing the plurality of printing elements into a plurality of blocks, and timings at which each of the plurality of blocks are driven, on the bases of the inclination information and the printing mode; and means for driving the plurality of printing elements on the bases of the division number B and the timings.

2. The printing apparatus according to claim 1, wherein the inclination information is information of a displacement amount, in the main scanning direction on the printing medium, between positions printed by the printing elements positioned on both end portions of the printing element array.

3. The printing apparatus according to claim 1, wherein the setting means sets the division number B and the timings so as to satisfy one of a first condition $B=N\times P$ (N and P are integers of not less than 1) and a second condition $P=M\times B$ (M is an odd number of not less than 1), where P is the number of the plural times).

4. The printing apparatus according to claim 1, wherein the setting means sets the division number B and the timings at which each of the plurality of blocks are driven, so as to satisfy one of a first condition B=N×P (N is an integer of not less than 1) and a second condition P=M×B (M is an odd number of not less than 1), as well as to reduce the displacement amount, where P is the number of the plural times.

5. The printing apparatus according to claim 1, wherein the setting means sets the division number B and the timings based on the inclination information and the printing mode by referring to a two-dimensional table.

6. The printing apparatus according to claim 1, wherein the timings are set so as to displace a printing position in the print main scanning direction by using 1 pixel in a printing resolution of the printing apparatus as a minimum unit.

7. The printing apparatus according to claim 1, further comprising:

means for detecting an inclination amount; and means for storing the inclination amount obtained by the detection means, wherein the inclination information acquisition means acquires the inclination amount by reading the inclination information from the storage means.

8. The printing apparatus according to claim 1, wherein the printing agent is ink containing a color material.

9. An inclination correction method for a printing apparatus which forms an image on a printing medium by alternately repeating print main scanning, in which a printing element array including a plurality of printing elements arranged in a predetermined direction is moved in a direction intersecting the predetermined direction, and sub-scanning, in which the printing medium is transported in a direction intersecting the print main scanning by an amount smaller than a width of the printing element array, the printing elements applying a color material onto the printing medium according to image data so that printing on a same image region of the printing medium is completed by repeating the print main scanning and the sub-scanning plural times, comprising the steps of:

acquiring inclination information on the printing element array;

acquiring a printing mode including information of a number of the plural times for the image data to be printed;

setting a division number B (an integer of not less than 1) for dividing the plurality of printing elements into a plurality of blocks, and timings at which each of the plurality of blocks are driven, on the bases of the inclination information and the printing mode; and driving the plurality of printing elements on the bases of the division number B and the timings.

* * * * *

UNITED STATES PATENT AND TRADEMARK OFFICE

CERTIFICATE OF CORRECTION

PATENT NO. : 7,325,900 B2
APPLICATION NO. : 11/480433
DATED : February 5, 2008
INVENTOR(S) : Masahi Hayashi et al.

It is certified that error appears in the above-identified patent and that said Letters Patent is hereby corrected as shown below:

COLUMN 2:
Line 11, “displacement ed” should read -- displaced --.
Line 22, “discharge” should read -- the discharge --.
Line 61, “are” should read -- is --.

COLUMN 3:
Line 13, “displacement ed” should read -- displaced --.

COLUMN 7:
Line 17, “exists ,” should read -- exists, --.
Line 18, “ment s” should read -- ments --.

COLUMN 8:
Line 6, “ment s” should read -- ments --.
Line 64, “ment s” should read -- ments --.

COLUMN 9:
Line 14, “with-reference” should read -- with reference --.
Line 42, “conditions” should read -- the conditions --.
Line 46, “blocks.” should read -- block. --.
Line 54, “of” should read -- of the --.

COLUMN 10:
Line 10, “blocks” should read -- block --.
Line 11, “divided” should read -- the divided --.

COLUMN 14:
Line 41, “which” should be deleted.

UNITED STATES PATENT AND TRADEMARK OFFICE

CERTIFICATE OF CORRECTION

PATENT NO. : 7,325,900 B2
APPLICATION NO. : 11/480433
DATED : February 5, 2008
INVENTOR(S) : Masahi Hayashi et al.

It is certified that error appears in the above-identified patent and that said Letters Patent is hereby corrected as shown below:

COLUMN 19:

Line 31, “ther-” should be deleted.
Line 32, “ebetween.” should read --therebetween. --.

COLUMN 20:

Line 22, “therefore” should read -- therefore, --.

Signed and Sealed this

Seventeenth Day of March, 2009

JOHN DOLL
*Acting Director of the United States Patent and Trademark Office*